US006959634B2

(12) United States Patent
Gross et al.

(10) Patent No.: US 6,959,634 B2
(45) Date of Patent: Nov. 1, 2005

(54) DEVICE FOR DIE CUTTING A STACK CONSISTING OF SHEET-TYPE MATERIALS

(75) Inventors: Helmut Gross, Hofheim (DE); Werner Bauer, Hanau (DE); Gerhard Becker, Eppstein (DE); Gerd Gottschalk, Kelkheim (DE); Richard Neubauer, Seligenstadt (DE); Horst Schneider, Hofheim (DE); Frank Stemmer, Babenhausen (DE)

(73) Assignee: Adolf Mohr Maschinenfabrik GmbH & Co. KG, Hofheim (DE)

( * ) Notice: Subject to any disclaimer, the term of this patent is extended or adjusted under 35 U.S.C. 154(b) by 0 days.

(21) Appl. No.: 10/031,669

(22) PCT Filed: May 15, 2001

(86) PCT No.: PCT/EP01/05514

§ 371 (c)(1),
(2), (4) Date: Feb. 26, 2004

(87) PCT Pub. No.: WO01/87556

PCT Pub. Date: Nov. 22, 2001

(65) Prior Publication Data

US 2004/0144228 A1 Jul. 29, 2004

(30) Foreign Application Priority Data

May 17, 2000 (DE) ..... 100 23 932

(51) Int. Cl.[7] ..... B26F 1/38; B26D 5/12

(52) U.S. Cl. ..... 83/569; 83/566; 83/698.91; 83/684; 83/911

(58) Field of Search ..... 83/698.91, 684, 83/911, 522.18, 569, 556, 639.1, 561, 527, 416, 438, 446, 448, 27, 50, 90, 149, 157, 465, 685, 81, 451, 417, 167, 162, 55; 270/95, 59, 52, 25.5, 58

(56) References Cited

U.S. PATENT DOCUMENTS

| | | | |
|---|---|---|---|
| 329,977 | A | 11/1885 | Brestel et al. |
| 958,459 | A | 5/1910 | Ames |
| 1,008,115 | A | 11/1911 | Clark |
| 2,220,056 | A | 10/1940 | Donnerberg et al. |
| 2,288,304 | A | 6/1942 | Schlattner |
| 2,483,735 | A | 10/1949 | Noell |
| 2,495,659 | A | 1/1950 | Noell |
| 2,956,321 | A | 10/1960 | Halward |

(Continued)

FOREIGN PATENT DOCUMENTS

| | | |
|---|---|---|
| CH | 540749 | 10/1973 |
| DE | 4013071 | 6/1991 |
| WO | 9612593 | 10/1995 |

*Primary Examiner*—Allan N. Shoap
*Assistant Examiner*—Ghassem Alie
(74) *Attorney, Agent, or Firm*—Price, Heneveld, Cooper, DeWitt & Litton, LLP

(57) ABSTRACT

The invention concerns a device for die-cutting a stack of sheet-like materials, particularly labels, whereby the stack is pressed into the die-cutter blade by a relative movement of a punching ram and a hollow cylindrical die-cutter blade.

Figure 1:
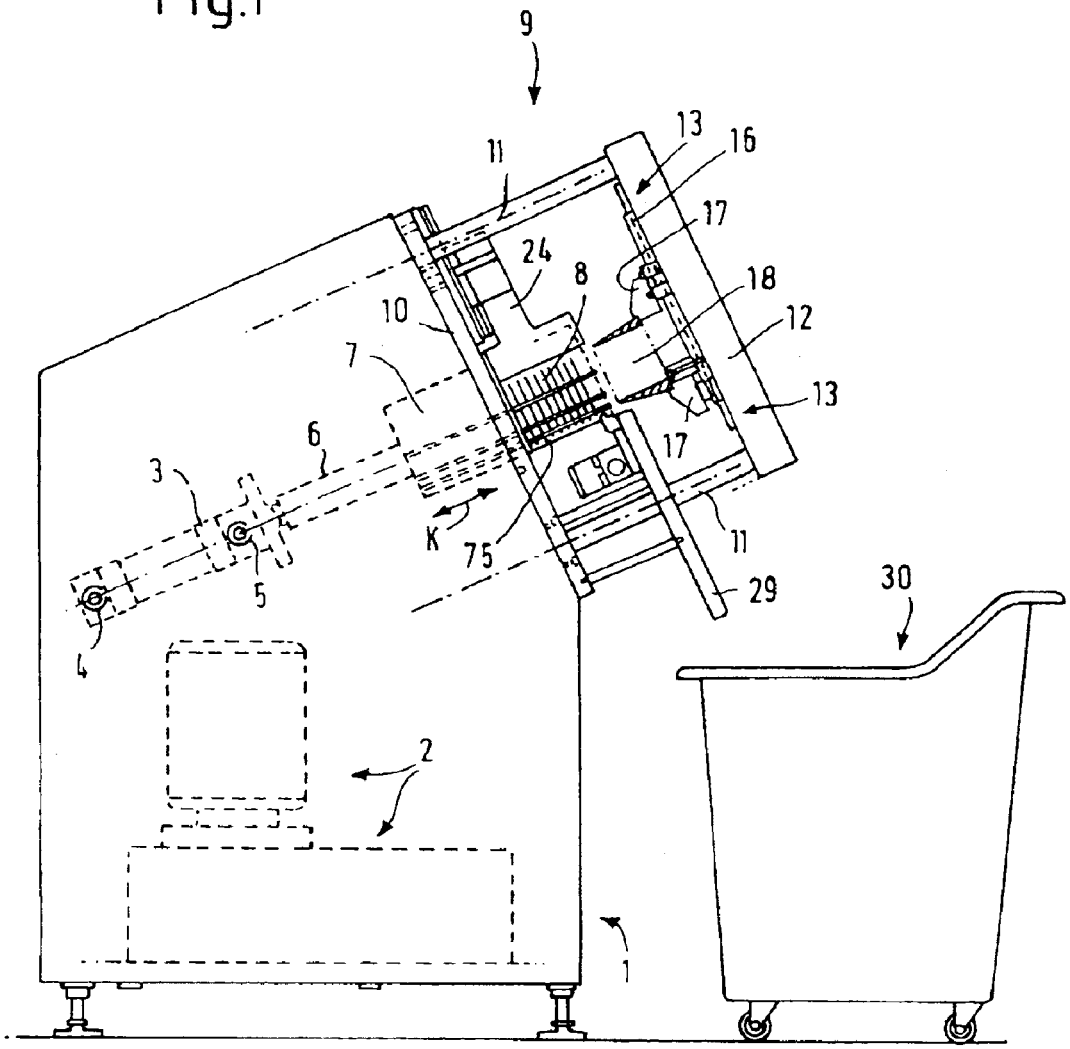

For a device such as this, it is proposed that the die-cutter blade 18 is adjustably held in a frame 16, and the frame 16 is accommodated by a receiving apparatus 13 which is mounted in a punch platen 12 and is adjustable relative to it, whereby the frame 16 can be slid in a plane parallel to the punch platen 12, in particular is adjustable in the direction of two major axes that are essentially arranged perpendicular to one another, and can also be tilted out of the plane.

Such a device allows for precise orientation of the die-cutter blade relative to the stack to be punched.

14 Claims, 19 Drawing Sheets

U.S. PATENT DOCUMENTS 3,113,515 A * 12/1963 Gaither et al. ..... 101/393
3,468,200 A 9/1969 Brestel et al.
3,479,914 A 11/1969 Busch
3,546,990 A 12/1970 Schneider
3,741,057 A 6/1973 Maschinot
3,881,343 A 5/1975 Ducate
3,982,458 A 9/1976 Terasaka
4,187,713 A 2/1980 Fellner
4,274,332 A 6/1981 Nakamura
4,501,179 A 2/1985 Iwata
4,590,788 A 5/1986 Wallis
4,602,497 A 7/1986 Wallis
4,610,185 A 9/1986 France
4,665,733 A 5/1987 Wallis
4,698,894 A 10/1987 Lingaraju et al.
4,911,281 A 3/1990 Jenkner
5,009,140 A 4/1991 Nolan et al.
5,183,247 A 2/1993 Blumer
5,460,479 A 10/1995 Neumann et al.
5,715,725 A * 2/1998 Schnell et al. ..... 72/481.2
5,768,963 A 6/1998 Bruehwiler
6,055,896 A 5/2000 Molison
6,324,951 B1 12/2001 Wegener
6,389,940 B1 5/2002 Long et al.

* cited by examiner

DEVICE FOR DIE CUTTING A STACK CONSISTING OF SHEET-TYPE MATERIALS

The invention relates to a device for die-cutting a stack of sheet-like materials, in particular a device for die-cutting a stack of labels. According to the type of device described, a stack is pressed into the die-cutter blade by a relative motion of the punching ram and a hollow cylindrical die-cutter blade. As a general rule, the die-cutter blade remains motionless during the actual die-cutting process while the punching ram presses the stack into the die-cutter blade.

A device of the aforementioned type is described in WO 96/12593. The essence of the die-cutting device described therein is that it provides an additional counter-pressure ram which serves the purpose of moving the punched stack back out of the die-cutter blade against the direction of thrust.

The object of the present invention is to produce a die-cutting device optimized versus known die-cutting devices, in which precise orientation of the die-cutter blade in relation to the stack to be punched is ensured.

The invention proposes a device for die-cutting a stack of sheet-like material as defined in claim 1. The frame itself is adjustable in a plane parallel to the punch platen, particularly adjustable in combination in the directions of two main axes that are essentially perpendicular to one another; and is also tiltable in said plane. So that the frame can follow the motion of the receiving apparatus on center, the frame is, for example, provided with a groove which essentially runs in the direction of one main axis, into which groove a centering bolt that is primarily moveable in the direction of the other main axis is set, and which bolt in particular is mounted in the punch platen. It is instructive for the receiving apparatus and/or the centering bolt to be adjustable via motors, whereby the adjustment preferentially occurs in synchrony. Servomotors are particularly suitable as adjustment drives. In particular, a clamping element is provided to lock the frame in the adjusted position within the receiving apparatus. This fixation and/or the fixation of the frame in the centering bolt is preferentially pneumatically achieved.

The device design cited ensures that the die-cutter blade, as held in the frame and placed into the device, can be oriented in defined fashion relative to the punching ram directed toward the stack, particularly in a plane perpendicular to the relative direction of motion of the punching ram and the die-cutter blade, in each case with respect to both translational and rotational aspects.

A preferred further development of the invention provides that the frame can be slid into the receiving apparatus perpendicular to the relative motion of punching ram and die-cutter blade, and can be locked in a centered position. The frame that accommodates the die-cutter blade is therefore not tilted into the receiving apparatus, which would necessitate a relatively large amount of space between the punching ram and the punch platen. Rather, the device is built very compactly, since the frame can be positioned in the narrowest space between the punching ram and the punch platen, in that said frame is instead slid into the receiving apparatus, indeed perpendicular to the relative direction of motion of punching ram and die-cutter blade. There the frame can be fixed in centered position, wherewith a pre-adjustment of the frame relative to the punch platen is achieved. The frame, and consequently the die-cutter blade, can be further adjusted inasmuch as the receiving apparatus is adjustable within the punch platen.

A further advantageous arrangement of the device concerns itself with the pre-adjustment of the die-cutter blade in the frame. Essential to this device is that the frame is provided with clamping elements for fixing the die-cutter blade in place, which elements are mounted within the frame and are adjustable and lockable relative to it, as well as with an adjusting element for aligned orientation of at least one orientation edge of the adjusting element with a section of the knife edge of the die-cutter blade prior to fixation of the adjusted clamping elements.

As such, it is not necessary to fix the die-cutter blade by feel, but rather this occurs by means of a separate adjusting element. It is sufficient to establish one, in particular straight, section of knife edge of the die-cutter blade as the relational parameter to be brought in line with the orientation edge of the adjusting element. This adjusting element is positioned on a defined portion of the frame such that aligned orientation of the orientation edge of the adjusting element and the section of knife edge of the die-cutter blade ensures exactly adjusted positioning of the cutting blade relative to the frame. The lateral orientation of the die-cutter blade relative to the frame can be accomplished in simple fashion via central markings placed onto the die-cutter blade on the one hand and onto the frame on the other, which are likewise to be brought into aligned agreement. The adjusting element may be arranged in various styles and manners. The adjusting element is of particularly simple construction when it is formed as an adjusting ruler. This rod-shaped element is placed on the frame in defined fashion and the orientation of the die-cutter blade occurs along one orientation edge of the adjusting ruler. The adjusting ruler is preferentially located a short distance behind the die-cutter blade, relative to the leading knife edge of the die-cutter blade. It is also conceivable to not only orient the die-cutter blade along one section of knife edge, but rather along the entire knife edge. This can be accomplished in a simple manner if the adjusting element is designed as an adjusting sheet parallel to the peripheral knife edge of the die-cutter blade and provided with an opening corresponding to cross-sectional opening of the die-cutter blade in the area of the knife edge. The adjusting sheet is located in front of the die-cutter blade relative to the leading knife edge of the die-cutter blade, for example, and is indeed oriented to the frame. The die-cutter blade is then positioned so that its peripheral knife edge coincides with the contour of the aperture of the opening in the sheet.

This arrangement considerably simplifies pre-adjustment of the die-cutter blade in the frame, such that only minor—if any—positional corrections of the die-cutter blade and/or frame with respect to the punching ram and the stack to be punched are necessary upon placement of the frame in the die-cutting device.

A further development concerns itself with the particular fixation of the die-cutter blade in the frame. In this context, it is essential that clamping elements, mounted in the frame and adjustable and lockable relative to it, are provided for fixation of the die-cutter blade. The frame exhibits a frame portion and a primary clamping beam that can be slid and locked within the frame portion, whereby the die-cutter blade is held in the primary clamping beam and in the frame portion, in a section of the frame portion that is arranged in parallel to the primary clamping beam. A secondary clamping beam, which can be slid and locked within the frame portion, is arranged in parallel to the primary clamping beam. Finally, clamping agents for clamping the primary and secondary clamping beams are provided in such a manner that the primary clamping beam can be tensioned against the die-cutter blade.

The frame portion and the primary clamping beam are thus charged with accommodating the clamping elements for fixation of the die-cutter blade. These clamping elements, which are, in particular, formed as clamping shoes, fix the die-cutter blade on sides of the die-cutter blade facing away from one another, such that the clamping elements of the primary clamping beam, under the influence of the clamping agents of the secondary clamping beam, press the die-cutter blade into the clamping elements of the frame. Once the clamping elements for the die-cutter blade have been brought largely into position and pre-tensioned, and the slideably frame-mounted primary clamping beam is also held relatively finnly—however so that it can still be slid—within the frame, the similarly slideable secondary clamping beam is positioned near the primary clamping beam and firmly tightened. By adjusting the clamping agents that contact the primary clamping beam, the die-cutter blade is firmly fixed between the clamping elements as a consequence of the primary clamping beam's slight relocation. The firm connection is then established between the primary clamping beam and the frame, wherewith the die-cutter blade is held particularly firmly to the frame.

The frame is preferentially of closed construction and consequently torsion-resistant. The connection between the primary and/or secondary clamping beam and the frame portion can be achieved via form or friction fit. According to a particular design, it is foreseen that the primary and/or secondary clamping beam can be connected to the frame portion in form-fitting fashion along wedge-shaped support sections of the frame portion, whereby the wedge of the respective support section thickens in the direction away from the die-cutter blade. It is ensured as a result of these wedge-shaped support sections that the connection of die-cutter blade and frame will not be loosened during operation. The corresponding applies to the connection of clamping elements and clamping beam and/or frame, if the clamping elements are provided with corresponding wedge-shaped support sections as well.

A further design concerns itself with the particular seating of the frame upon the punch platen and the direct introduction of punching forces from the die-cutter blade to the punch platen via those frame areas associated with the die-cutter blade. The die-cutter blade is held adjustably in the frame, which is held in the receiving apparatus that is connected to the punch platen. The receiving plate exhibits the two gibs arranged in parallel, between which the frame is held. The frame exhibits a frame portion and at least one adjustable clamping beam within the frame portion for fixation of the die-cutter blade. The clamping beam rests upon the punch platen in the vicinity of the beam's ends; moreover, the leg of the frame portion which serves to receive the die-cutter blade rests upon the punch platen. The section of the frame portion facing away from this section of the frame portion is arranged at a distance from the punch platen.

According to an advantageous further development, an additional clamping element is provided which works upon the section of the frame portion facing away from the die-cutter blade, indeed in such manner that the frame portion is pressed against that gib which is located in the area of the die-cutter blade.

The die-cutting device according to the present invention may be designed differently with due regard to the features of the generic terms of the patent claims. In the sense of the publication WO 96/12593 as discussed, it is not necessary for a counter-pressure ram that generates counter-pressure on the stack to be functioning within the die-cutter blade. As a general rule, so-called "press-through punching" will be employed, in which a stack of pre-cut labels, particularly rectangular labels, is pressed through the die-cutter blade in a single stroke. The die-cut labels are automatically pushed through the die-cutter blade by the subsequent stack.

Further features of the invention are presented in the dependent claims, the description of the figures and in the figures themselves. It is noted that all individual features and all combinations of individual features are essential to the invention.

Figure 2:
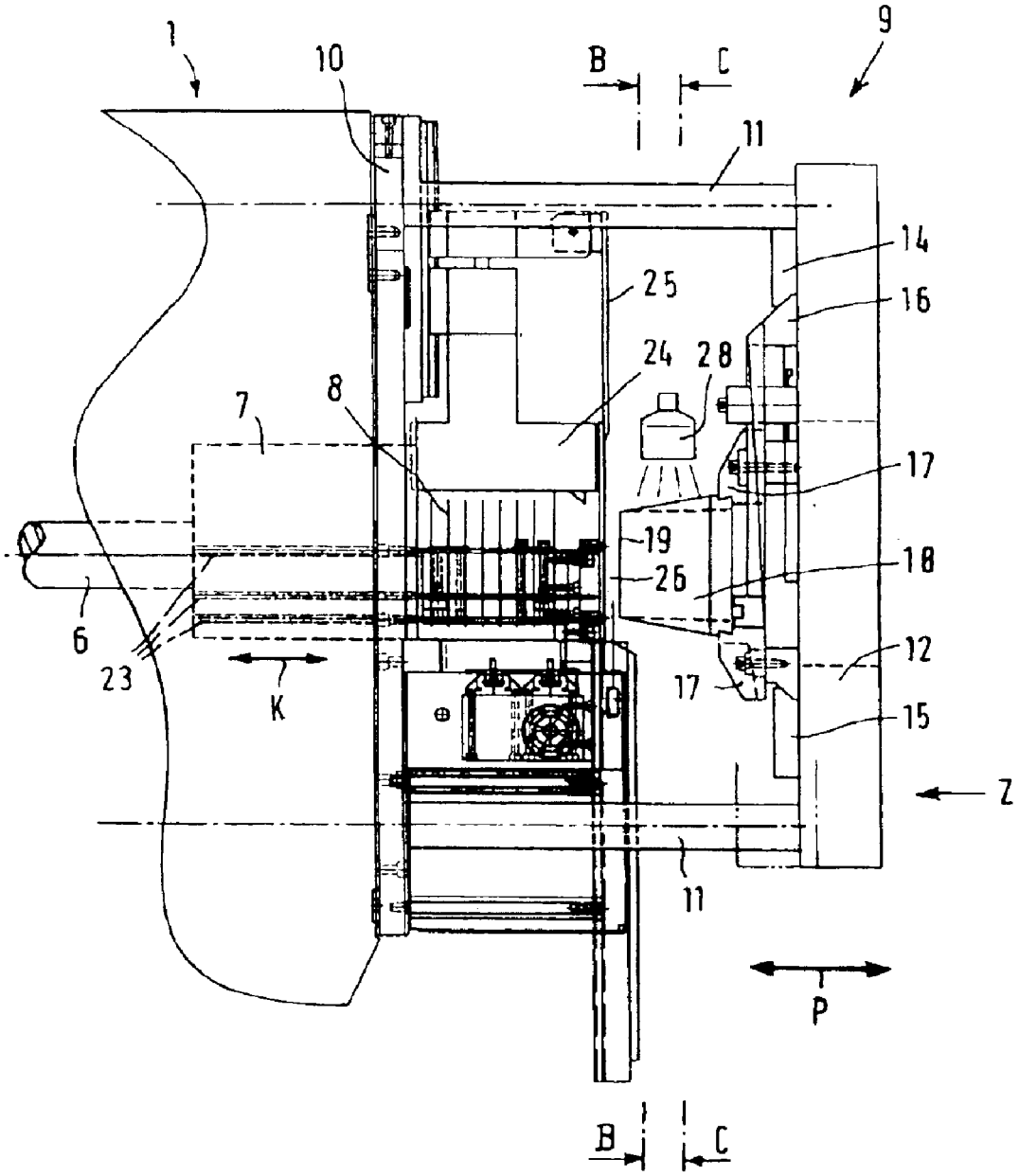
Figure 3:
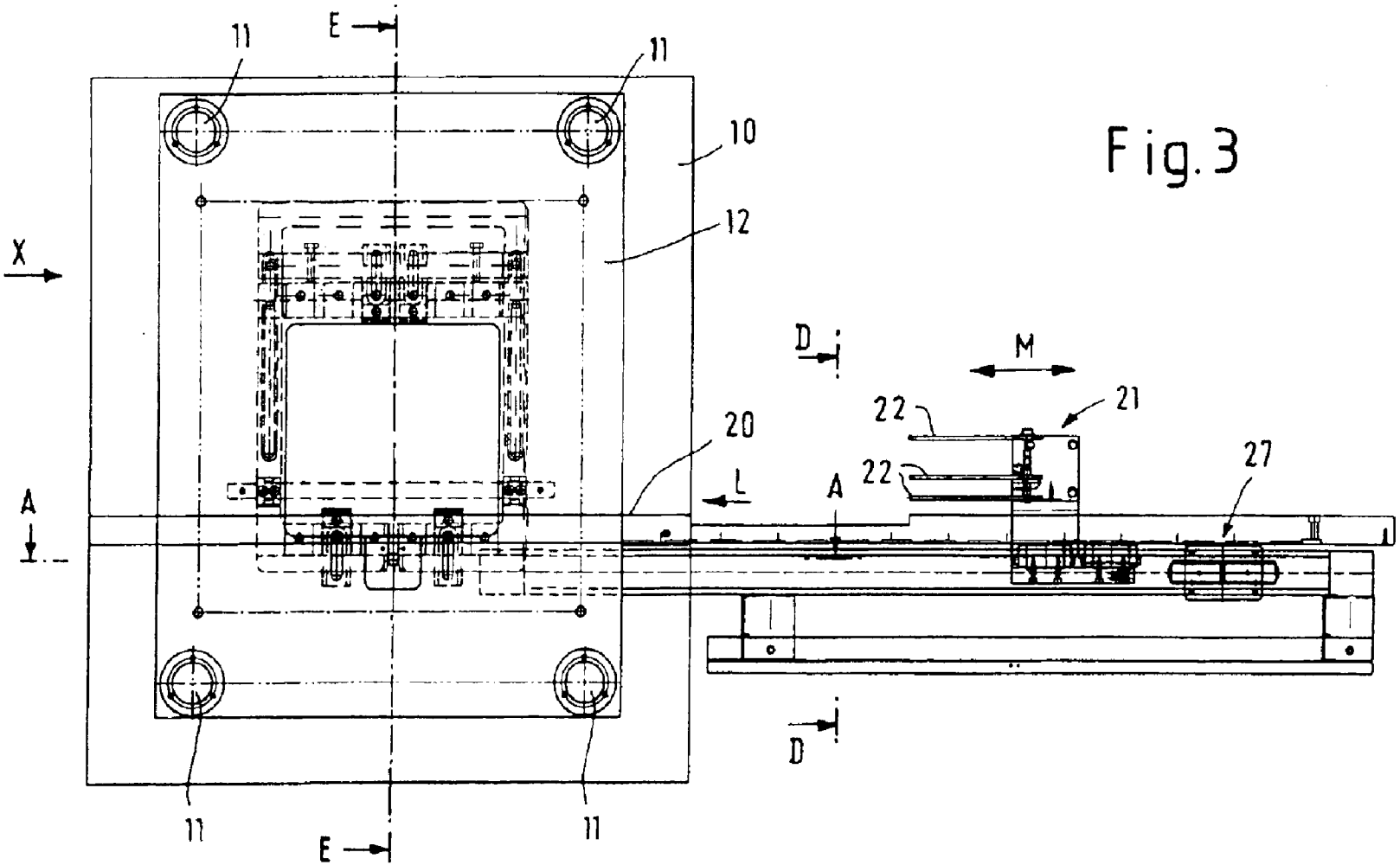
Figure 4:
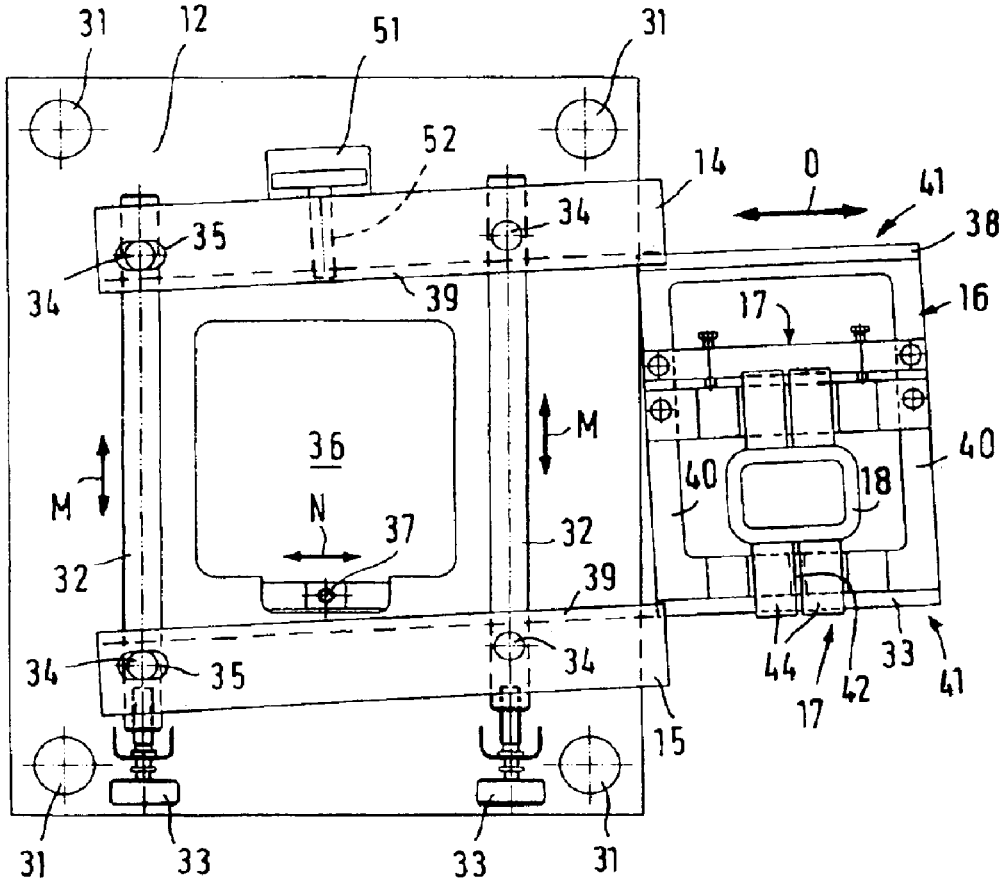
Figure 5:
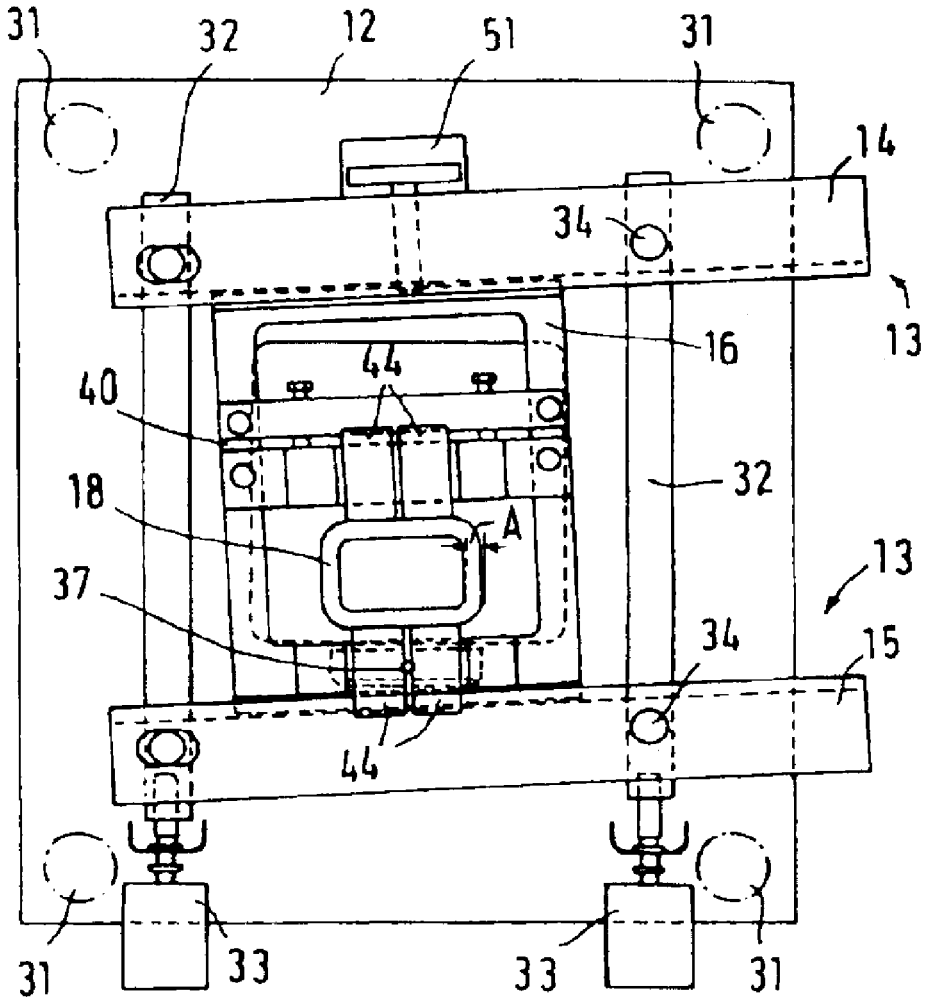
Figure 6:
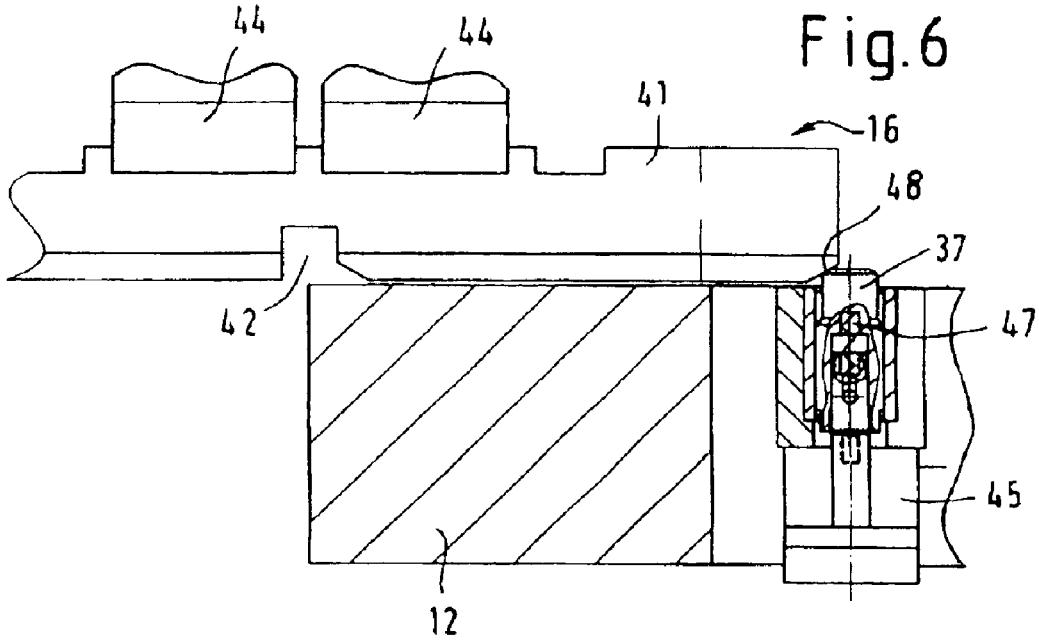
Figure 7:
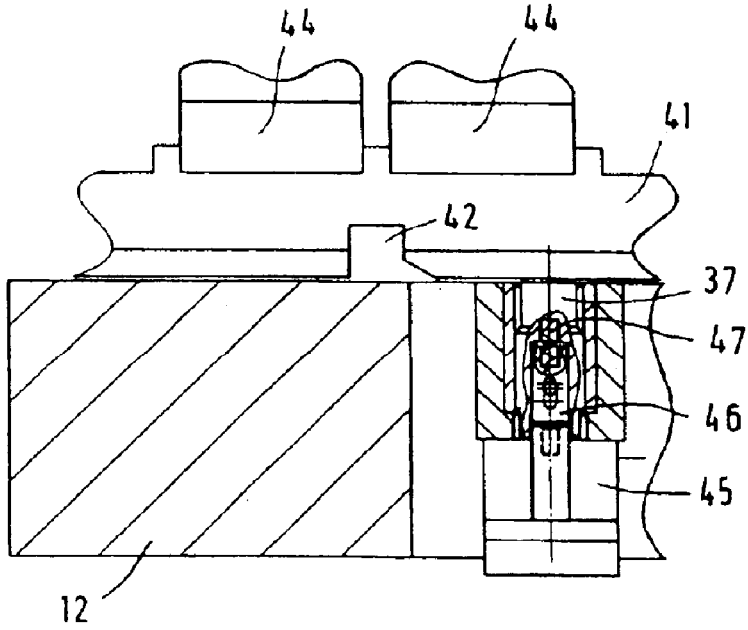
Figure 8:
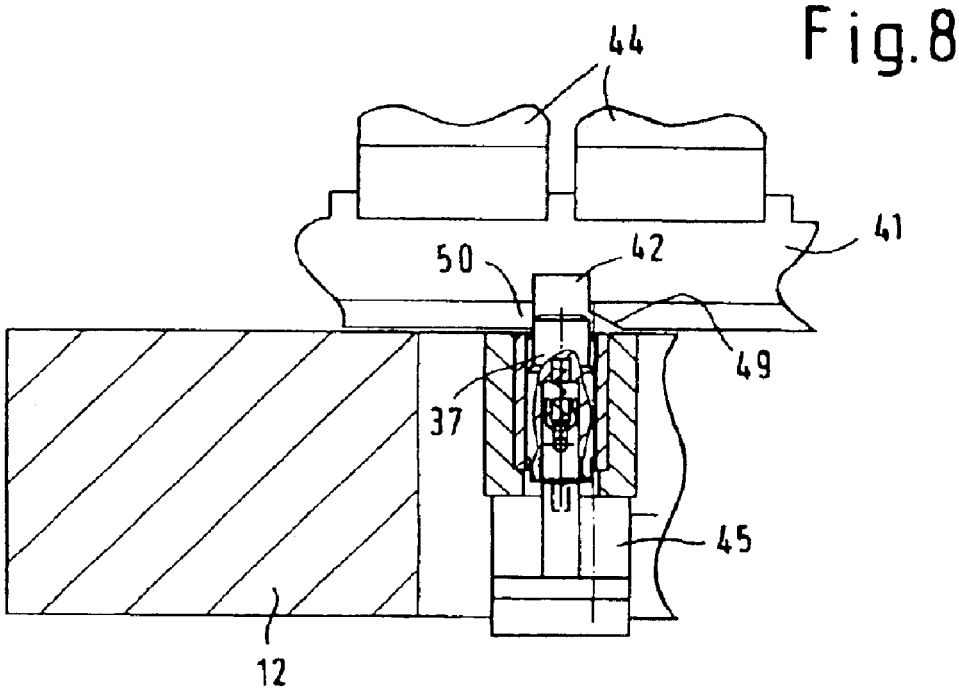
Figure 9:
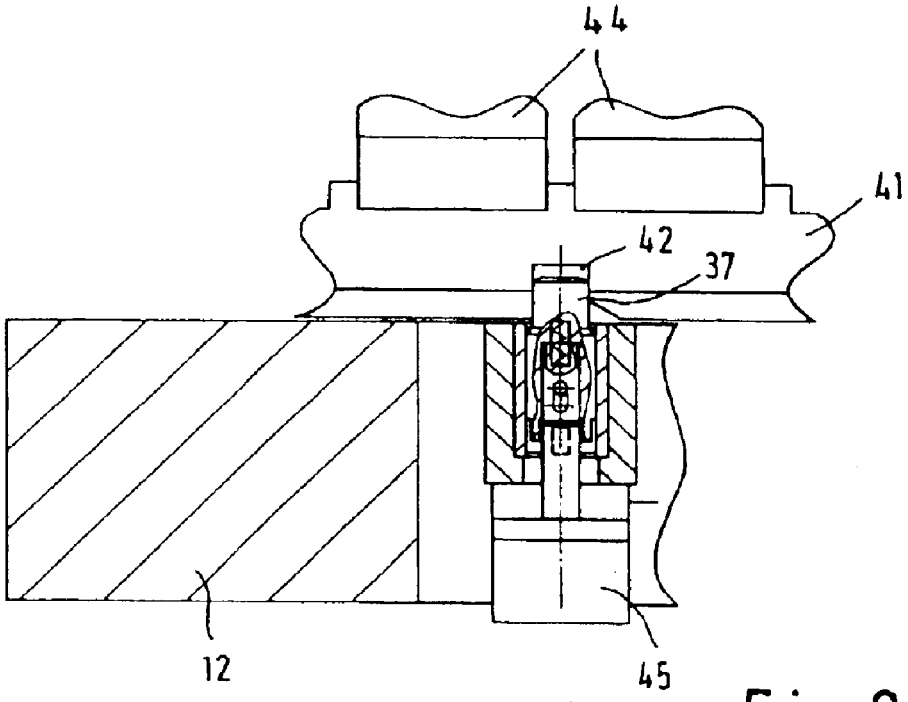
Figure 10:
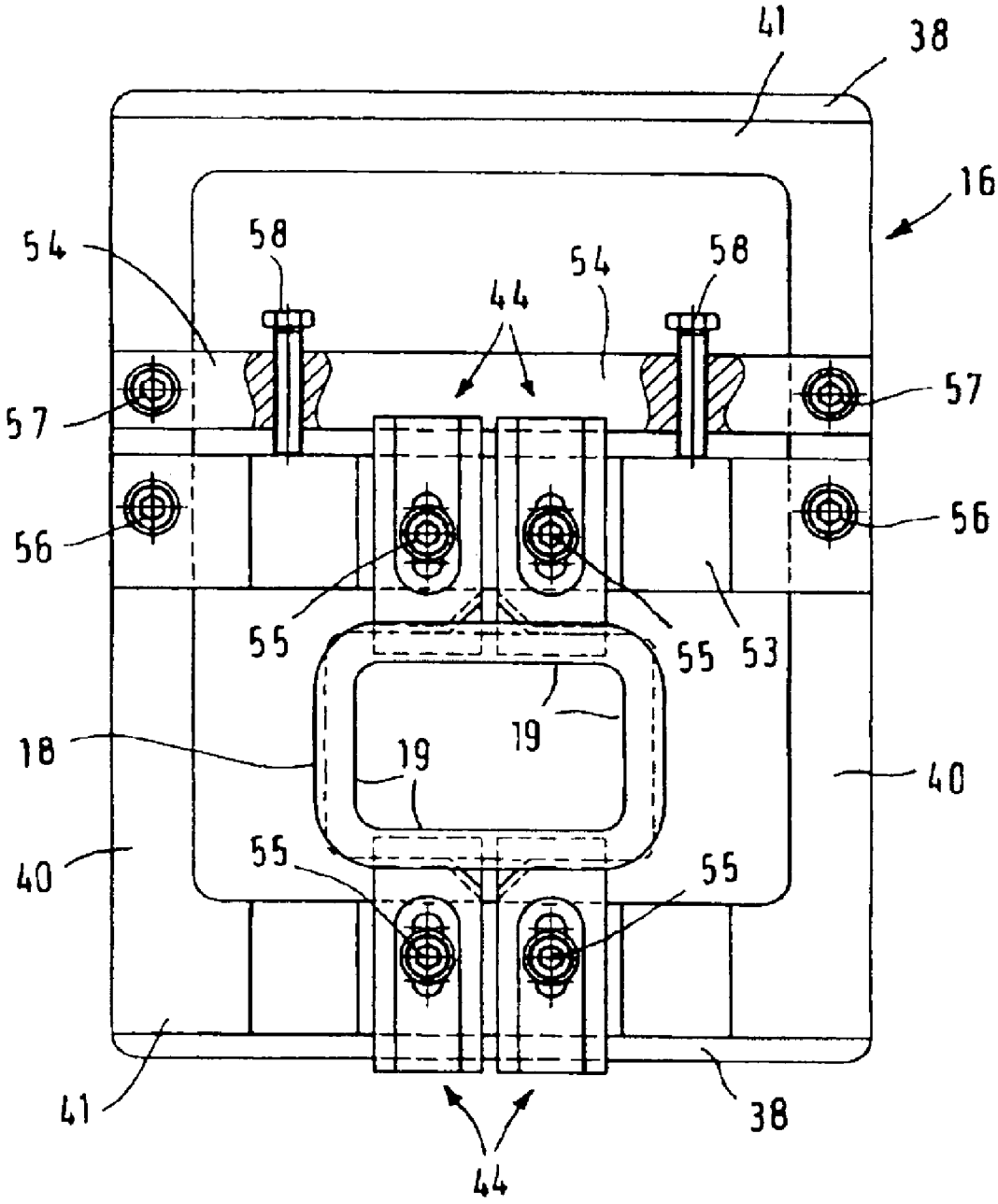
Figure 13:
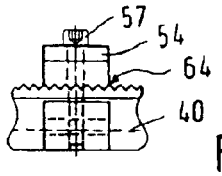
Figure 12:
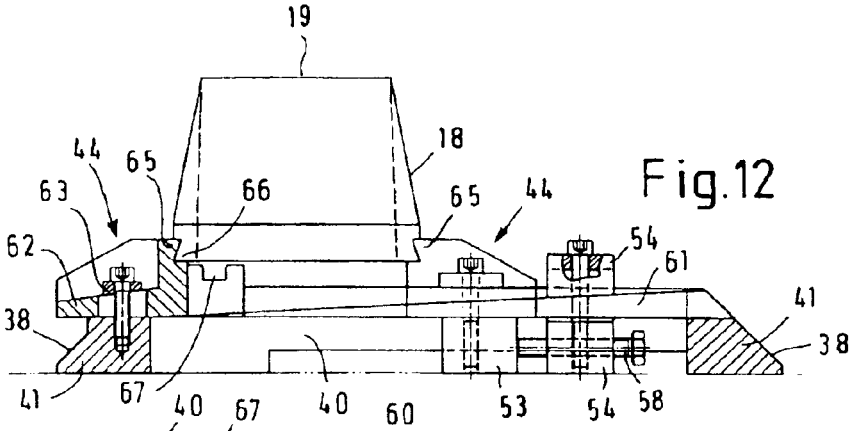
Figure 11:
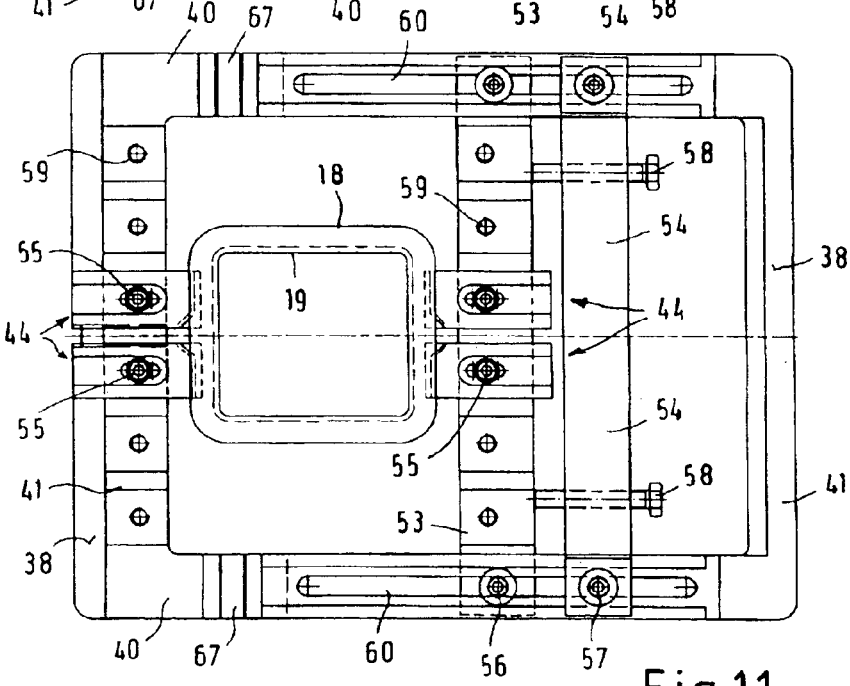
Figure 14:
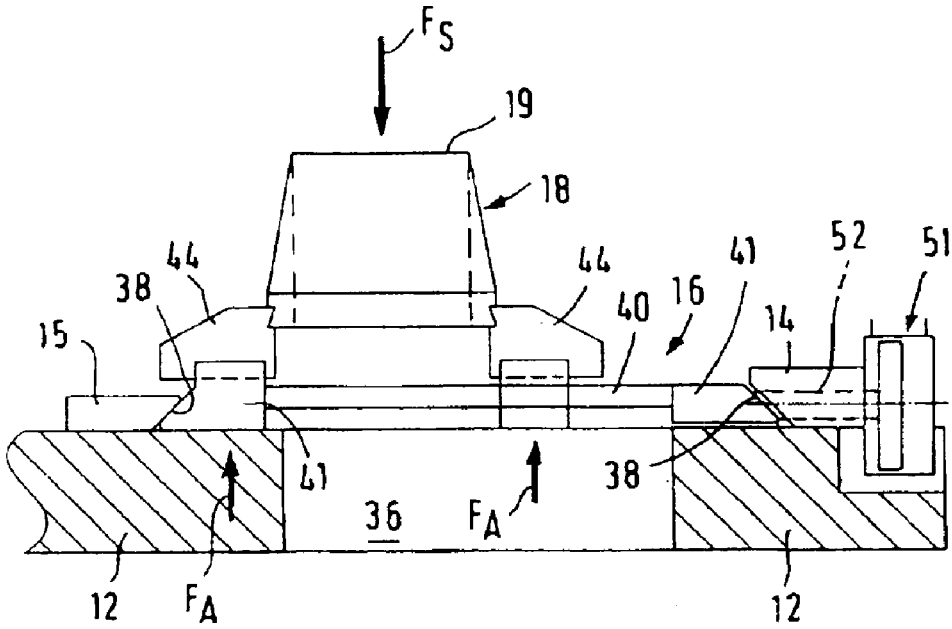
Figure 17:
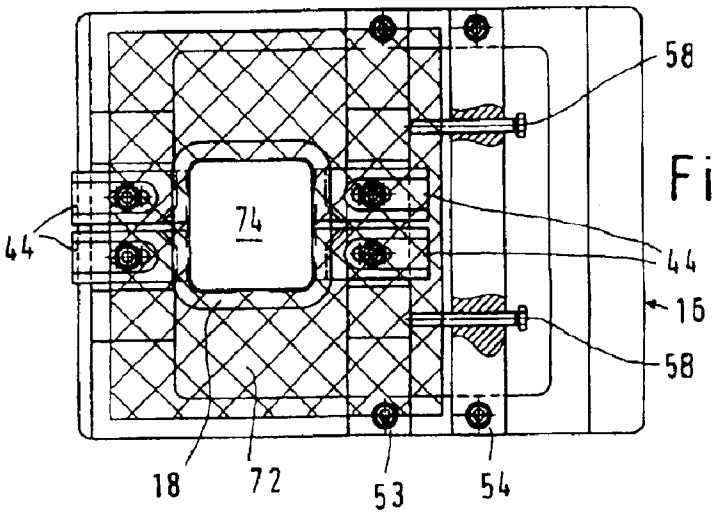
Figure 18:
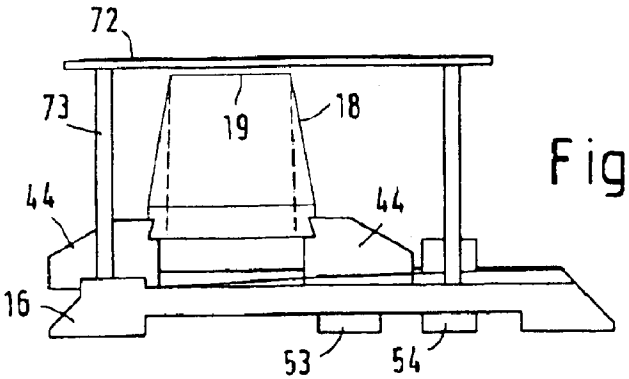
Figure 15:
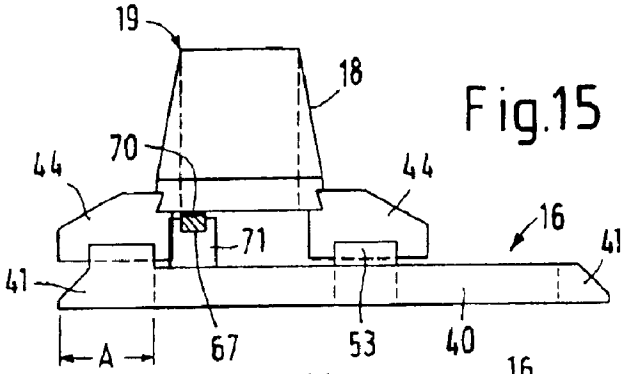
Figure 16:
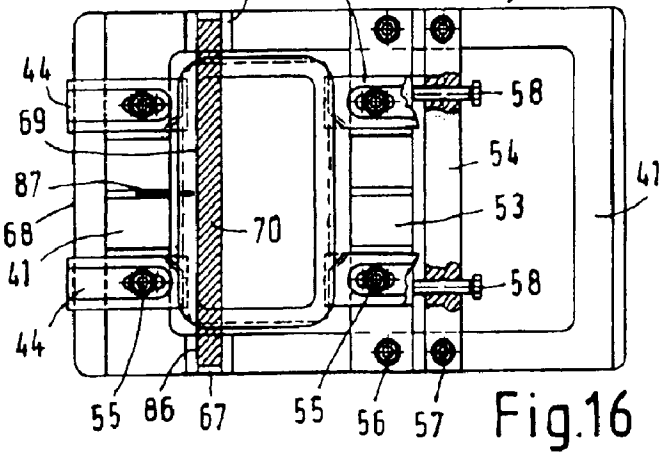
Figure 19:
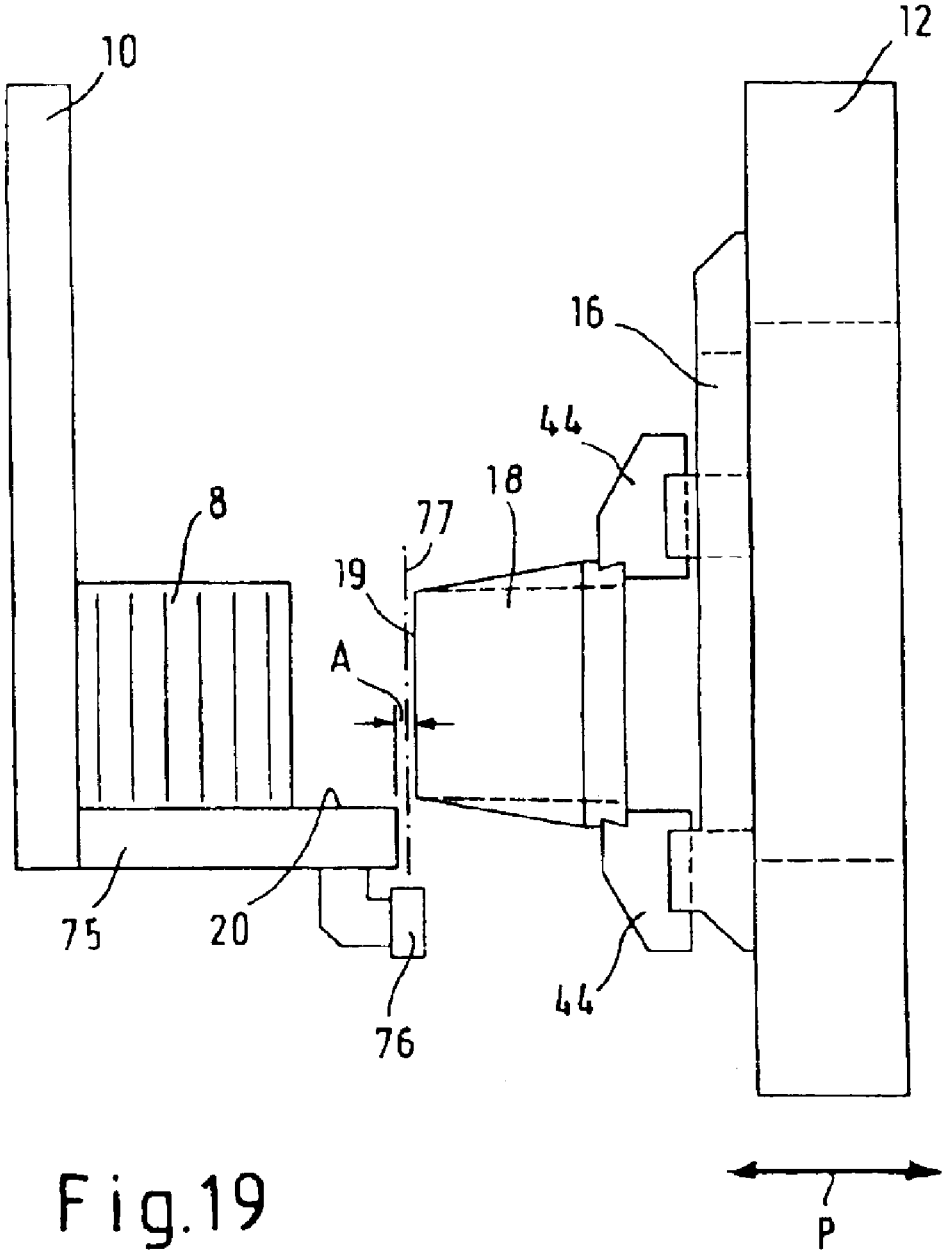
Figure 20:
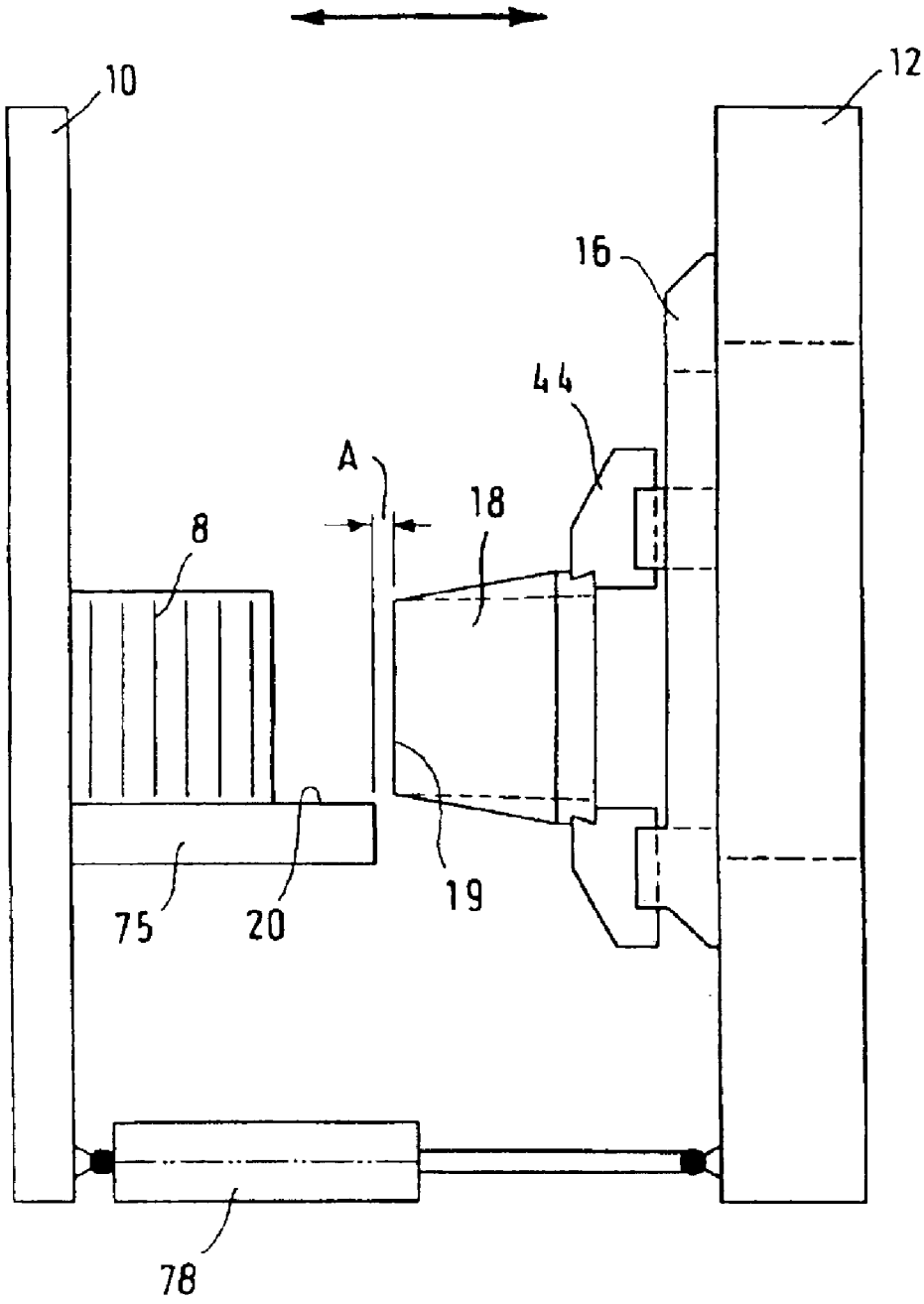
Figure 21:
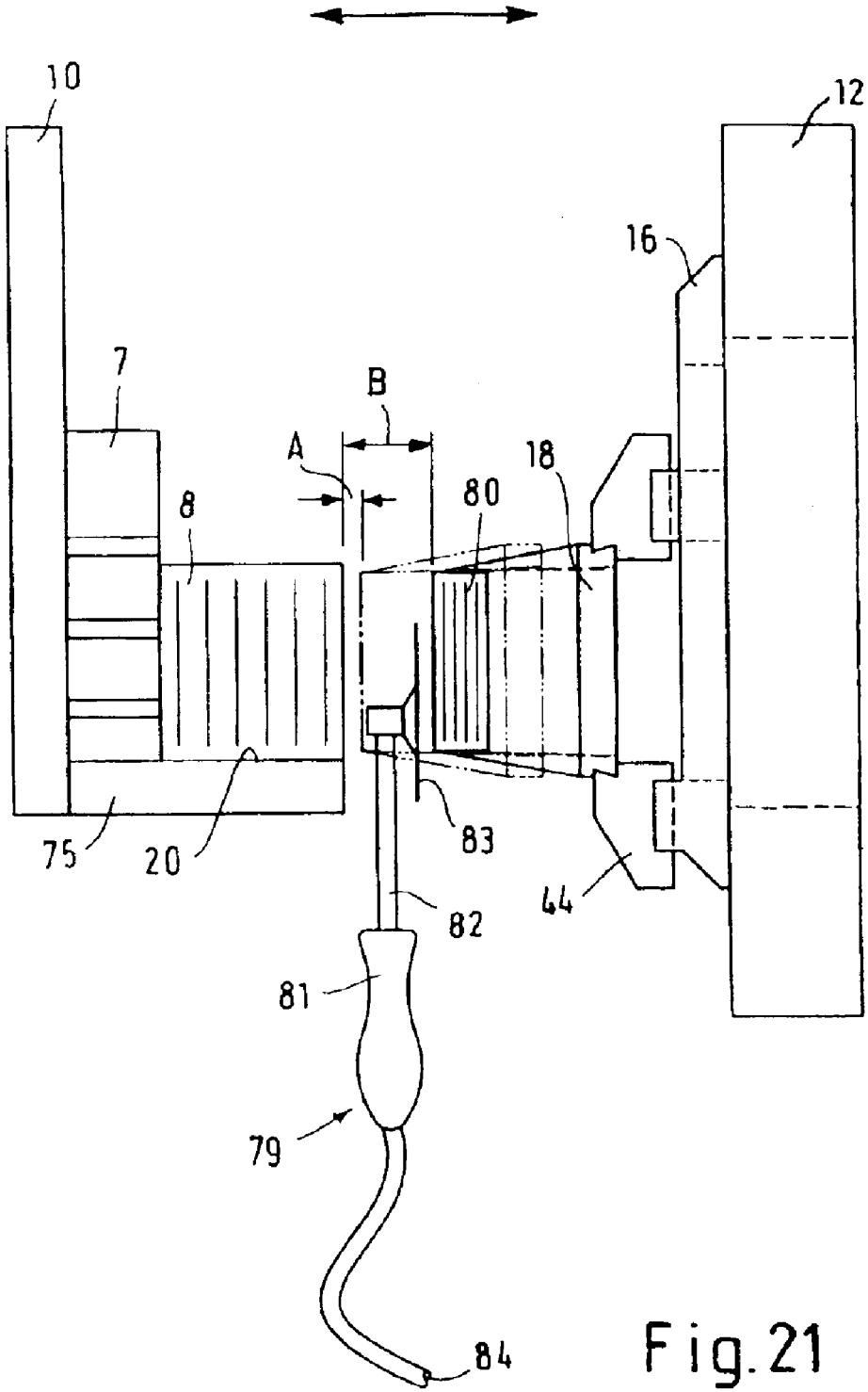
Figure 22:
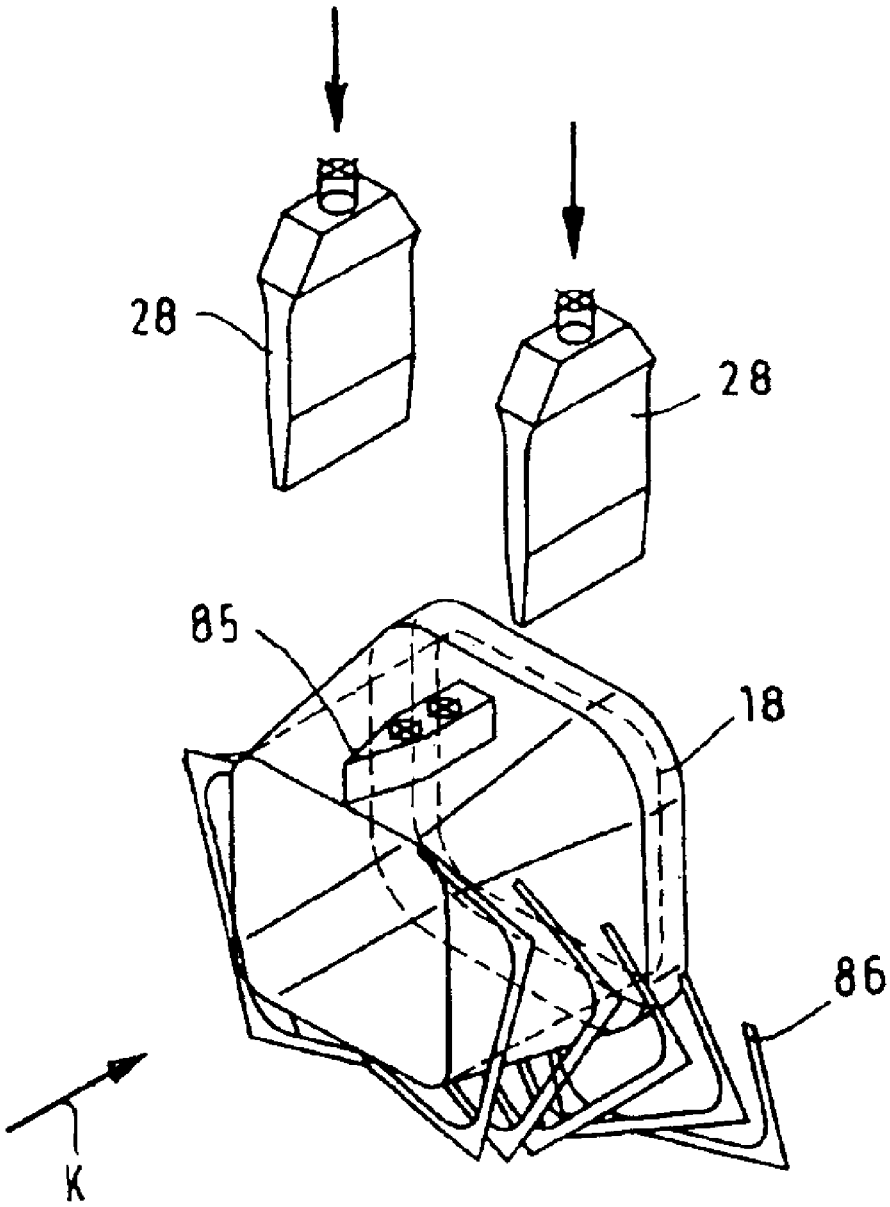
Figure 23:
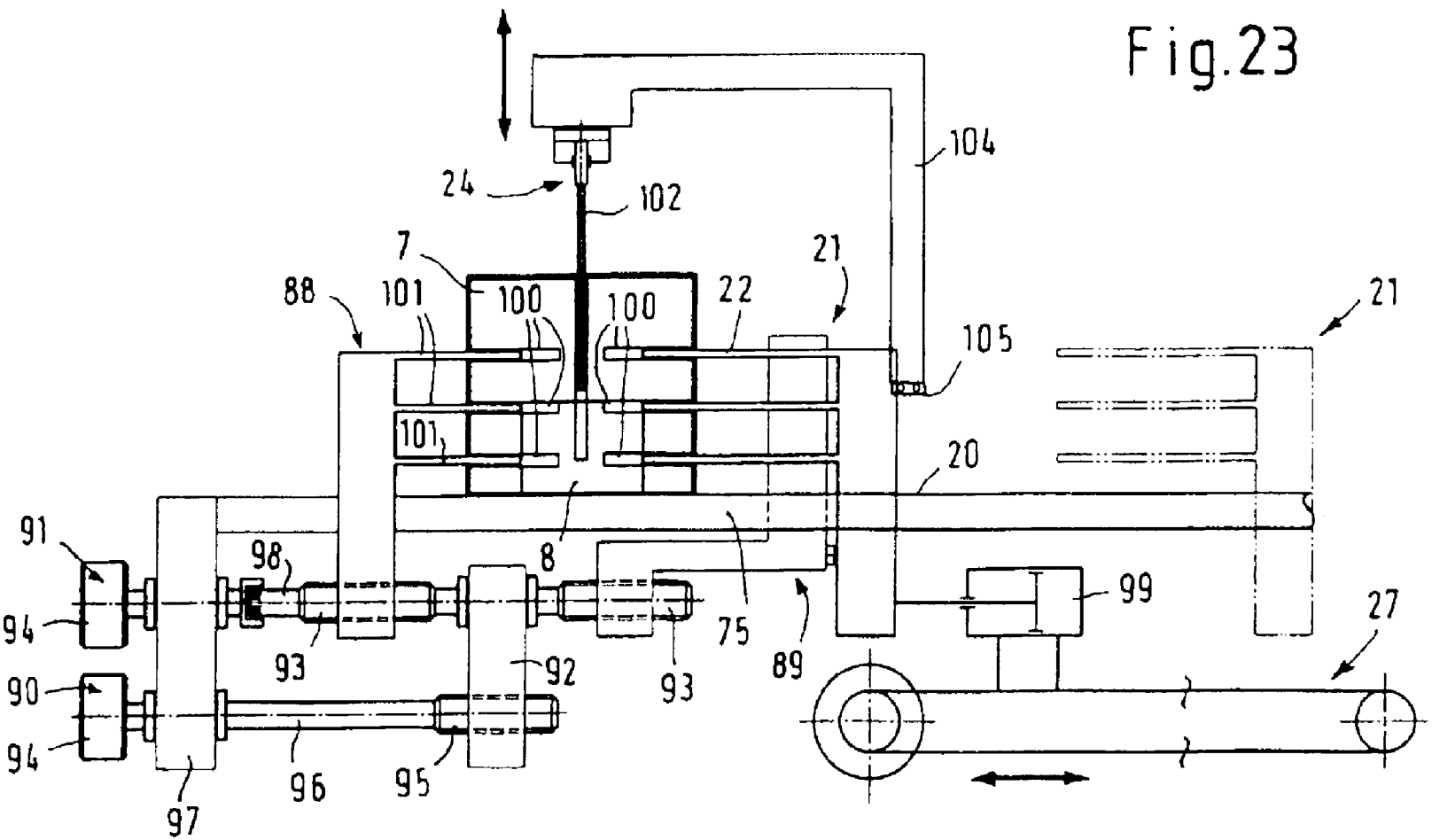
Figure 24:
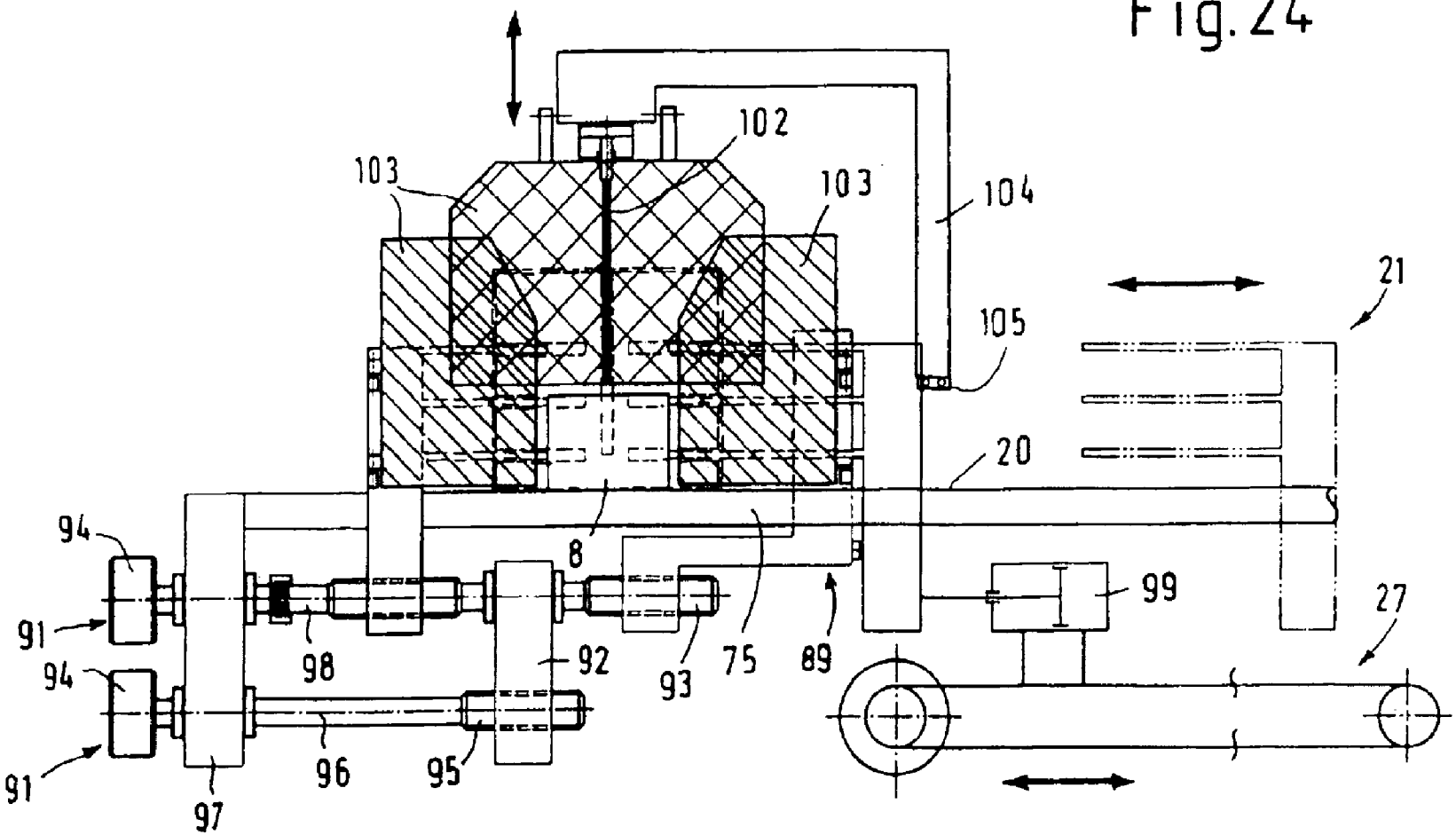
Figure 25:
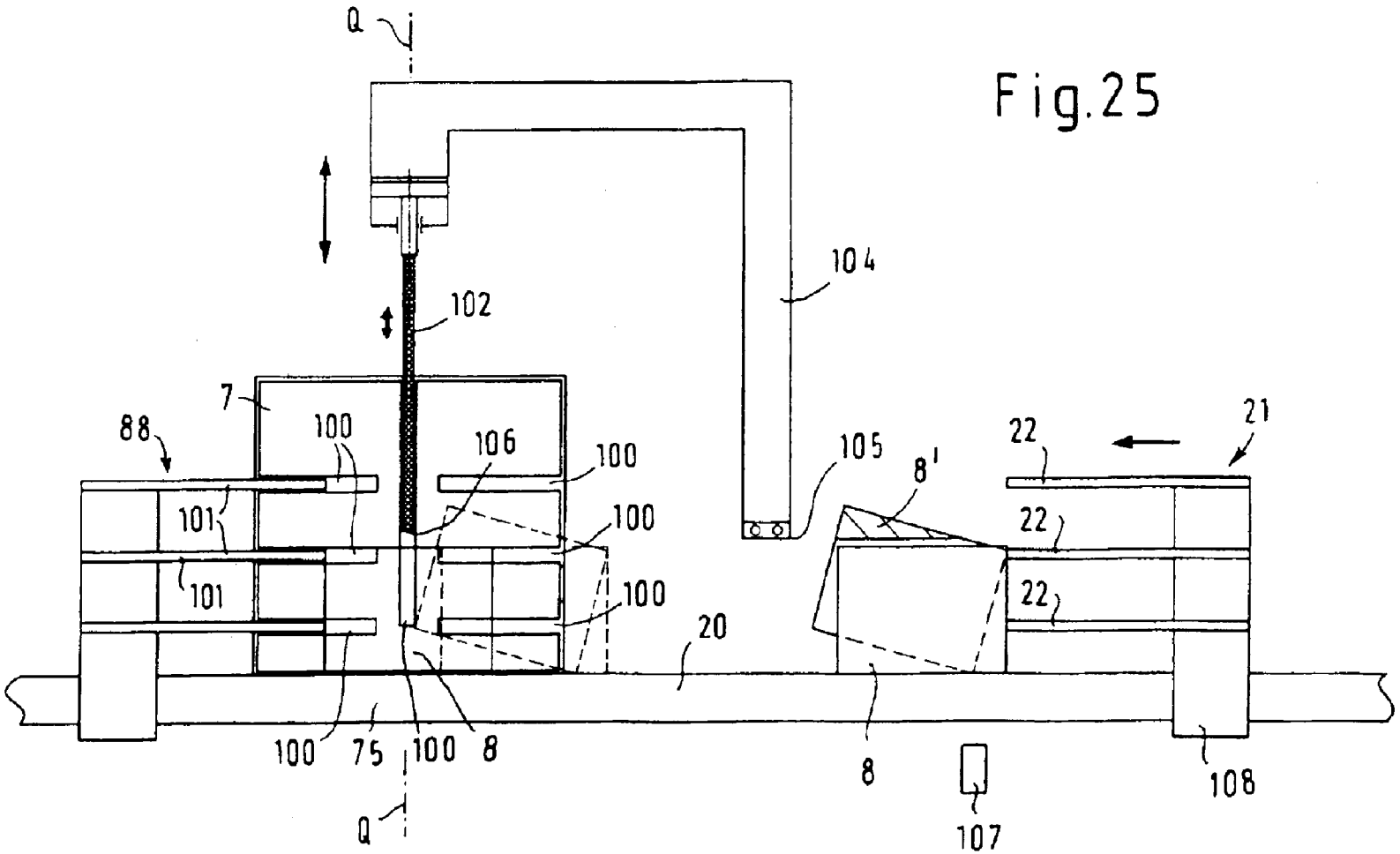
Figure 26:
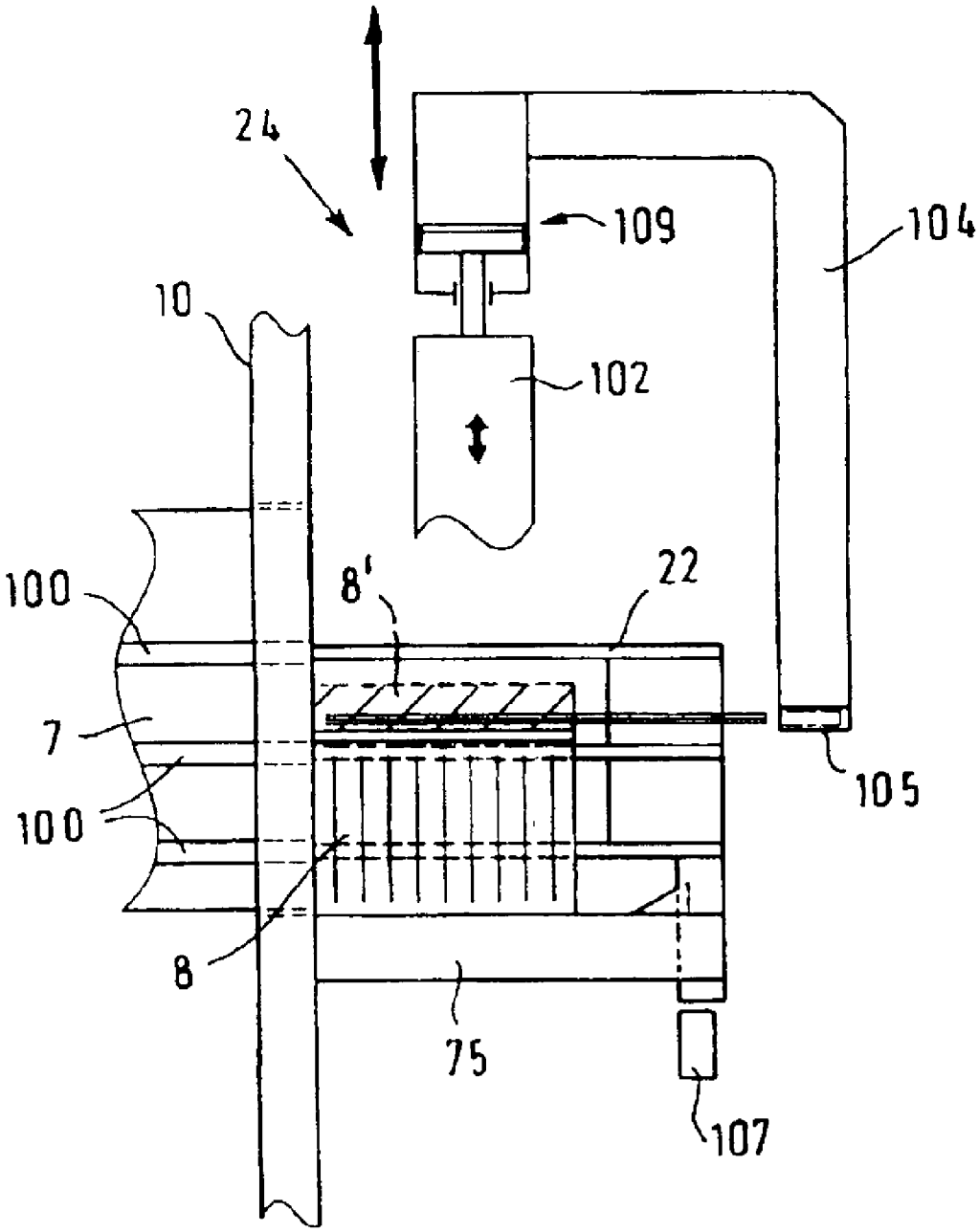

The figures schematically represent a die-cutting device that works according to the principle of "press-through punching" without being limited to the depicted embodiment form and/or the modifications demonstrated in this context. Schematically illustrated are:

FIG. 1 the die-cutting machine according to the present invention in a side view, FIG. 2 an enlarged lateral representation of the actual die-cutting device as depicted in FIG. 1, FIG. 3 a view in accordance with "Z" of FIG. 2 of the die-cutting device and the apparatus for introducing the stack to be punched, FIG. 4 a section corresponding to line "B—B" of FIG. 2, however prior to placement into the receiving apparatus of the frame that accommodates the die-cutter blade, FIG. 5 a representation corresponding to FIG. 4, however with a frame placed and centered in the receiving apparatus, FIG. 6 a section corresponding to line "A—A" in FIG. 3, illustrating the condition of placing the frame in the receiving apparatus, FIG. 7 a section corresponding to FIG. 6, illustrating the condition of subsequently sliding the frame into the receiving apparatus, FIG. 8 a section corresponding to FIGS. 6 and 7, illustrating the condition of centering the frame, FIG. 9 a section corresponding to the FIGS. 6 to 8, illustrating the condition of fixation of the frame in the punch platen, FIG. 10 an enlarged view of the frame depicted in FIGS. 4 and 5 with die-cutter blade, FIG. 11 top view of a frame design as modified versus the embodiment according to FIG. 10 with the die-cutter blade accommodated by said frame, FIG. 12 a section through the frame depicted in FIG. 11, FIG. 13 a detailed representation of a modified, form-fitting connection of frame and clamping beam, FIG. 14 a section corresponding to line "E-E" in FIG. 3 for clarification of the mounting of the die-cutter blade in the punch platen, FIG. 15 a side view of the frame and the die-cutter blade accommodated by it, as well as an adjusting ruler being used, FIG. 16 a top view of the arrangement depicted in FIG. 15, FIG. 17 a top view corresponding to FIG. 16, however making use of an adjustment sheet that serves in the adjustment of the die-cutter blade, FIG. 18 a side view of the arrangement depicted in FIG. 17, FIG. 19 a view "X" corresponding to FIG. 3 for clarification of the height adjustment of the die-cutter blade using a sensor, FIG. 20 a view "X" corresponding to FIG. 3 for clarification of the die-cutter blade height adjustment by means of a distance measurement system, FIG. 21 a view "X" corresponding to FIG. 3 for clarification of the arrangement and organization of a label remover, FIG. 22 the pressurized-air cleaning device employed in the die-cutting device, FIG. 23 a section corresponding to line "C—C" of FIG. 2 for clarification of the stack feed and dimensional adjustment, FIG. 24 covers for the die-cutter area, shown in addition to the components represented in FIG. 23, FIG. 25 a representation corresponding to FIG. 23, however with clarified functioning of the erroneous contour recognition, FIG. 26 a section corresponding to line "D—D" of FIG. 3 through the stack feed area of the machine, The fundamental construction of the die-cutting machine is illustrated in FIGS. 1 to 3.

A machine housing 1 accommodates the electrical aggregates of the controlling system for the machine, as well as a drive system for the machine's hydraulics. These elements of the machine are illustrated by the element block 2 within the machine housing 1. An hydraulic cylinder 3 with connections 4 and 5 for hydraulic lines is mounted within the machine housing 1 at an oblique orientation to horizontal. The piston rod 6 of the hydraulic cylinder accommodates a punching ram 7 in the area of its upwardly directed, free end. Said ram can therefore be moved back and forth in the direction of the double arrow "K" and serves to push any stack 8 in its path, which stack is composed of sheet-like materials. The orientation of the individual sheets in the stack is indicated by lines. The machine housing 1 terminates in the area of the punching ram 7, perpendicular to the longitudinal axis of the piston rod 6. In this area of the housing, the machine housing 1 is flange-mounted to the actual die-cutting device. Its side facing the machine housing 1 exhibits a main plate 10 flange-mounted to the housing, which plate is provided with four boreholes in the area of its corners. The boreholes are traversed by guide pins 11, which can only be slid axially. Adjustment drives connected to the guide pins 11 in the interior of the machine housing 1 are not illustrated. The upwardly-directed, free ends of the guide pins 11 are associated with a punch platen 12 positioned in parallel to the main plate 10. The side of the punch platen 12 facing the main plate 10 exhibits a receiving apparatus 13. Components of the receiving apparatus 13 are formed by two horizontally-positioned gibs 14 and 15 arranged in parallel, between which a rectangular frame 16 can be slid. The side of this frame 16 facing the main plate 10 exhibits clamping elements 17 which hold a die-cutter blade 18 designed as a hollow cylinder. The peripheral contour of the blade's Knife Edge is indicated by reference character 19.

Pre-cut stacks, such as a stack 8 of labels cut in a guillotine press, also referred to as "Nutzen," are pushed sideways in the direction of arrow "L" along a plane clarified by line 20 by way of multiple guide fingers incorporated into a design unit 21, until said stack reaches a stop in the area of the punching ram 7, which stack has not been depicted in greater detail. As can be deduced from the representation in FIG. 2, the guide fingers are designed in plate-form and extend to a height that is greater than the maximum stack height. As can be deduced from the representation in FIG. 3, the plates are arranged at a distance from one another. Dashed lines in FIG. 2 illustrate slots 23 for the guide fingers 22, which can also be moved in the direction of the double arrow "K". A sword-shaped hold-down 24 is mounted in the upper area of the main plate 10 and immobilizes the punching ram 7 from above, once it has been brought into position. An upper, plate-shaped punch area cover is indicated with reference character 25; lateral punch area covers with reference character 26.

The design unit 21 exhibiting the guide fingers 22 is moved in the direction of the double arrow "M" to push the stack 8 into the actual punch area by means of a continuous belt, whereby the back and forth movement of the design unit 21 is controlled by the upper section of the belt.

During operation, and with the punching ram 7 retracted as shown clearly in FIG. 1, the right-parallelepiped-shaped stack 8 of labels is moved against a stop that has been adjusted according to the size of the stack by the guide fingers 22, such that the stack 8 is positioned symmetrically relative to the "E—E" axis. When the punching ram 7 is extended, it presses the stack against the die-cutter blade 18, causing the stack 8 to be pressed through the die-cutter blade 18 in a single stroke. The punch platen 12 remains stationary relative to the main plate 10 in the process. Their separation distance is only adjusted by moving the guide pins 11 further into or out of the machine housing 1 when, for example, the die-cutter blade has been resharpened and therefore exhibits a reduced height, or when a new die-cutter blade has been placed. In such cases, a height correction, i.e. a correction of the distance between main plate 10 and punch platen 12, is to be made.

After die-cutting a stack 8, the punching ram 7 is retracted back into the initial position in accordance with FIG. 1, the next stack 8 is fed into the area of the punching ram 7 from the side, and this stack 8 is then pressed through the die-cutter blade 18 by means of the punching ram 7, whereby the pressing of this Stack pushes the previously pressed stack 8 out the back of the die-cutter blade 18 from whence it is directed to further processing. Ring-shaped scrap, generated outside the die-cutter blade during punching, is disposed of with a blower device 28 directed down toward a diverting plate 29 leading to a scrap container 30. For reasons of visual clarity, representations of the frame and the die-cutter blade, as well as secondary details described in the other figures, were omitted from FIG. 3.

FIGS. 4 to 9 illustrate the arrangement of the frame 16 in the receiving apparatus 13, as well as the fixation of the frame 16 in the punch platen 12, as well as the mounting of the moveable receiving apparatus 13 in the punch platen 12.

FIG. 4 clarifies details of the punch platen 12 with the four boreholes 31 for receiving the guide pins 11. Within the punch platen 12, two guide rods 32 are arranged parallel to one another in the direction of the double arrow "M" and are mounted to allow axial adjustment. The axial adjustment of the guide rods 32 is accomplished by means of independently controllable servomotors 33. The mounting of the guide rods 32 is not illustrated. The one guide rod 32 illustrated in the right of the drawings accommodates both gibs 14 and 15 with no radial play via two pivot bearings 34 whose pivot axes run perpendicular to the punch platen 12. The other guide rod 32 is correspondingly provided with pivot bearings 34 which, however, accommodate the gibs 14 and 15 with play, and which are accommodated in slotted holes 35 running in the longitudinal direction of gibs 14 and 15. When the guide rods 32 are adjusted, the gibs 14 and 15 always move in parallel to one another; however in one case a rectangle and in another case an oblique square may be formed, according to whether the guide rods 32 have been slid in like or in opposite direction; moreover, complete movement of the receiving apparatus 13 in the direction of either the upper or lower boreholes 31 is possible.

The punch platen 12 exhibits a central, essentially quadratic opening 36 through which the die-cut material is routed. In the area facing the gib 15 adjacent to the opening 36 in the punch platen 12, a centering bolt 37 is mounted in parallel orientation to the pivot bearings 34, which bolt faces the side of the punch platen 12 associated with the receiving apparatus 13. The centering bolt 37 is held in a movement apparatus (not depicted in greater detail) which allows said apparatus to be moved in the direction of the double arrow "N", hence perpendicular to the longitudinal extrapolation of the guide rods 32 in the plane of the illustration sheet.

Gibs 14 and 15 are designed as wedged gibs, between which the frame 16 can be slid in the sense of the double arrow "O" and from which said frame can be withdrawn. FIG. 4 illustrates the relationships prior to sliding in the frame 16, for example. The side of the frame facing the gibs 14 and 15 exhibits beveled regions 38 that articulate with the projections 39 of the gibs 14 and 15. The separation distance of the two gibs 14 and 15 is set such that the frame 16 can be slid in between the gibs with little play. The frame 16 accommodates the die-cutter blade 18 which has been pre-adjusted in an as yet to be described manner. The frame 16 consists of two long, parallel, lateral legs 40 and two parallel short legs 41 which conneci them, whereby the leg 41 associated with gib 15 exhibits a relatively large extension in relation to the longitudinal direction of the lateral leg 40. The underside of this short leg 41, i.e. the side facing the centering bolt 37, is provided with a t-slot 42 that runs parallel to the longitudinal direction of the lateral leg 40. The process of sliding the frame 16 in between the gibs 14 and 15 is illustrated in FIGS. 6 to 9; however, as opposed to the representations in FIGS. 4 and 5, not from right to left, but rather from left to right. Depicted is the wider short leg 41 of the frame 16, which is provided with two clamping shoes 44 to hold the die-cutter blade 18 on one side of the die-cutter blade. The underside of this leg 41 is provided with a t-slot 42 that extends perpendicular to the plane of the illustration sheet. The moveable centering bolt 37 is set into a recess of the punch platen 12. Said bolt can be moved in and out by means of a pneumatic cylinder 45, whereby the pneumatic cylinder 45 works upon a thrust piece 46, between which piece and the centering bolt 37 a spring 47 is located. Upon sliding the frame 16 between the gibs 14 and 15 as illustrated in FIG. 6, a leading bevel 48 of the frame leg 41 initially presses against the centering bolt 37, and presses it into the punch platen 12 against the force of the spring 47 so that the frame 16 can be further slid in between the gibs 14 and 15. This stage is illustrated in FIG. 7. As soon as the frame 16 has been slid in far enough for the centering bolt 37 to find itself in line with the t-sloc 42, the spring 47 pushes the centering bolt 37 out slightly, until the spring 47 reaches a stop. The centering bolt 37, which projects just slightly above the surface of the punch platen 12, has slid out along a further bevel 49 of the frame leg 41 and laterally contacts a projection 50 on the frame, thereby establishing the centered position of the frame, as illustrated in FIG. 9. As illustrated in FIG. 9, the frame 16 is fixed in position relative to the punch platen 12 in that the centering bolt 37 is extended by impingement of the pneumatic cylinder 45, whereby said bolt traverses the t-slot 42 in the frame.

The adjustment capability of the centering bolt in the direction of the double arrow "N" allows the frame 16 to be moved back and forth between the two guide rods 32. The movement capability of the gibs 14 and 15 by means of the two guide rods 32 is ensured since the centering bolt 37 is able to follow the pre-determined movement of the gibs 14 and 15 in the longitudinal direction of the t-slot 42. This set-up enables the frame 16 and hence the die-cutter blade 18 held by the frame, as well as the stack 8 which will be pushed forward by the punching ram 7, to be oriented at will relative to the punch platen 12. Removal of the frame for resharpening of the die-cutter blade 18 or exchange of the die-cutter blade 18 for a new die-cutter Blade, for example, is accomplished in the reverse manner.

When the frame 16/die-cutter blade 18 are oriented in position for the die-cutting operation, the Frame held between the gibs 14 and 15 is tensioned against gib 15 by means of a pneumatic clamping cylinder 51 mounted in gibs 14 and 15, the slide ram 52 of which cylinder acts upon the frame 16 in the area of the narrow, short leg 41. A certain necessary amount of play between the frame 16 and the two gibs 14 and 15 is thereby eliminated.

FIGS. 10 to 14 illustrate the details of the mounting of the die-cutter blade 18 in the frame 16, as well as the mounting of the frame 16 in the punch platen 12. As can be deduced in the embodiment according to FIG. 10, which corresponds to that of FIGS. 4 and 5, the die-cutter blade 18 is held by means of a pair of clamping shoes 44 which grip one of the opposing sides of the die-cutter blade. One of the pairs of clamping shoes 44 formed by the two clamping shoes 44 is threaded into the wide, short leg 41 of the frame 16, whereas the pair formed by the other two clamping shoes 44 is threaded into a primary clamping beam 53 which is arranged in parallel to the legs 41 and itself threaded into the lateral legs 40 of the frame 16. This clamping beam 53, exactly like a second clamping beam 54 arranged in parallel to it, is slideably mounted in the lateral leg 40 along its longitudinal direction. The primary clamping beam can therefore always be slid in tightly against the die-cutter blade 18 in relation to the magnitude of the die-cutter blade 18, which the clamping shoes 44 of the die-cutter blade 18 grasp from both sides. The screws 55 associated with the clamping shoes and the screws 56 associated with the primary clamping beam 53 are then tightened slightly and the screws 67 associated with the secondary clamping beam 54 tightened more firmly, such that the secondary clamping beam 44 can no longer be slid relative to the lateral legs 40. The screws 58 which traverse the secondary clamping beam 54 in the plane of the frame are driven against the primary clamping beam 53 and exert a permanent pre-tensioning on the primary clamping beam 53, whereby permanent clamping of the die-cutter blade 18 between the clamping shoes 44 is ensured. The screws 55 and 56 are subsequently tightened.

The slots 60 that run in the longitudinal direction of the lateral legs 40 for the purpose of sliding the two clamping beams 53 and 54 are depicted with respect to the modified form according to FIGS. 11 and 12. The primary clamping beam 53 and the wide, short leg 41 exhibit multiple adjacently arranged threaded holes 59 so that the clamping shoes 44 can be connected with the primary clamping beam 53 and/or the wide, short leg 41 at a suitable distance from one another relative to the width of the die-cutter blade 18 in use. The embodiment according to FIGS. 11 and 12 differentiates itself from that according to FIG. 10 however, in that the secondary clamping beam 54, which exerts pre-tensioning onto the primary clamping beam 53 via the screws 58, is mounted in an upper section of the respective lateral leg 40 that is shaped like a wedge 61, so that a secure fixation of the die-cutter blade 18 between the clamping shoes 44 is ensured even after periods of its extended use. Not only is a displacement of the secondary clamping beam 54 countered on the basis of the wedge 61; but rather the clamping shoes 44 are also threaded by means of screws 55 into the wide, short leg 41 and the primary clamping beam 53 over wedge-shaped bevels that increase in thickness toward the die-cutter blade 18. As can be deduced from the representation in FIG. 12, the screws 55 traverse slotted holes that are oriented in the longitudinal direction of the lateral leg 40 and the screws are provided with wedge-shaped washers 63.

Instead of the wedge 61 for secure positioning of the secondary clamping beam 54 away from the die-cutter blade 18, a form-fitting connection may be provided between the lateral legs 40 and the secondary clamping beam 54, as illustrated in FIG. 13. This form-fitting connection is effected via serrated mesh surfaces 64 between leg 40 and clamping beam 54.

FIGS. 11 and 12 illustrate that the clamping shoes 44 are provided with projections 65 that form a step-like, acutely angled setback, which serves to accommodate a complementary contour 66 of the die-cutter blade 18. It is further illustrated that the two lateral legs 40 adjacent to the wide, short leg 41 are provided with slots 67 that run parallel to it for accepting an insertion ruler as to be described in greater detail below.

FIG. 14 illustrates that the punching force $F_S$ is transferred directly, and therefore along the shortest path, as a bearing pressure $F_A$ to the wide, short leg 41 and the primary clamping beam 53, which directly support themselves against the punch platen 12. In contrast, the narrow, short leg 41 does not lie directly on the punch platen 12. The slide ram 52 of the clamping cylinder 51 presses against the beveled region 38 of this leg 41 and not only causes the frame 16 to be pressed against the gib 15, but also the frame 16 to be impinged with a force vector in the direction of the punching force $F_S$. It is not mandatory for the clamping cylinder 51 to be mounted in the gibs 14 and 15; the possibility also exists to mount it in the punch platen 12. In this case, however, relatively long adjustment paths for the slide ram 52 of the clamping cylinder 51 must potentially be effected, depending upon the positional location of the frame 16.

FIGS. 15 to 18 show adjusting elements for pre-adjusting the die-cutter blade 18 in the frame 16. In accordance with a defined Distance A, which is to be maintained between the end edge 68 of the frame 16 in the area of the wide, short leg 41 and the most closely adjacent, straight section 69 of the knife edge 19, a rod-shaped adjusting ruler 70 is placed in the defined slots 67 of the frame 16. The slots 67 are preferentially mounted in an elevating element 71 of the frame 16 so that the adjusting ruler 70, when placed in the slots 67, is positioned just underneath the die-cutter blade 18. While the fastening elements are still loose, the die-cutter blade 18 is positioned such that the associated straight section 69 of the knife edge 19 is aligned with the edge of the adjusting ruler 70 which faces the wide, short leg 41. The two clamping beams 53 and 54, as well as the clamping shoes 44 are fastened in this constellation. Positioning of the die-cutter blade 18 in the longitudinal direction of the ruler 70 occurs via central markings 87 that have been placed on the outside of the die-cutter blade 18 and/or the adjacent area of the frame 16.

Instead of an adjusting ruler 70, an adjusting sheet 72 is used in the embodiment according to FIGS. 17 and 18. Said sheet is connected to a support 73 that can be connected to the frame 16, whereby the adjusting sheet 72 is arranged in parallel to the peripheral knife edge 19 of the die-cutter blade 18. The adjusting sheet 72 is provided with an opening 74, the cross-section of which corresponds to the opening cross-section of the die-cutter blade 18 in the area of the knife edge 19. The die-cutter blade 18 and its opening cross-section are oriented relative to the adjusting sheet 72 such that said cross-section is coincident with the opening 74 of the adjusting sheet 72.

FIG. 19 depicts the die-cutter blade 18 held in the frame 16 by the clamping shoes 44 in conjunction with the height adjustment of the die-cutter blade 18, and the frame 16 mounted in the punch platen 12. The main plate 10 of the machine housing 1 is provided with a storage plate 75 perpendicular to the former, that extends in the direction of the die-cutter blade 18 for storing the stack 8. A sensor 76 which projects beyond the end edge of the storage plate 75 is connected to the lower side of the storage plate 75, which sensor detects a Separation Distance A in front of the the end edge of the storage plate 75 in the sense of the depicted line 77 parallel to the main plate 10. The punch platen 12 is driven via non-depicted, motorized adjusting agents in the direction of double Arrow "P" by means of adjusting drives associated with the guide pins 11 such that the knife edge 19 coincides with the line 77. FIG. 20 illustrates an alternative embodiment, which provides no sensor 76, but rather a distance measurement system 78 to determine the distance between the main plate 10 and the punch platen 12, which system, by way of example, is initialized when the main plate 10 and the punch platen 12 are at a position of maximum separation and then moves the two parts toward a defined separation distance corresponding to the Separation Distance A between the end edge of the plate 75 and the knife edge 19.

FIG. 21 depicts the arrangement and design of a Label Remover. In the course of continuous "press-through punching", pressed-through labels 80 find themselves in the die-cutter blade 18, as well as labels yet to be pressed in the area of the punching ram 7, as illustrated by the stack 8. In order to remove one or more of the most recently punched labels 80, the main plate 10 and the punch platen 12 are moved apart, resulting in a wider Gap B than the initial Gap A between the front surface of the storage plate 75 and the knife edge 19. The wider gap is large enough to allow introduction of the label remover 79. The label remover 79 is introduced manually in particular, and exhibits a handle 81, and a tube 82 connected to it which accommodates a plate-shaped probe 83, as well as a vacuum connection 84. At a minimum, the most recently punched label 80, positioned in the plane of the knife edge 19, is drawn by vacuum against the flat, plate-shaped probe 83 introduced and can thus be removed by means of the label remover 79, in order to subsequently examine the label 80 for quality outside of the die-cutting device.

FIG. 22 illustrates that two air jets 28, arranged in the area of the die-cutter blade, are directed toward the die-cutter blade 18 from above and thus essentially perpendicular to the feed direction of the stack 8. The die-cutter blade 18 exhibits an external ripping knife 85 on the side facing the air jets 28 to cut through the ring-shaped punching scrap 86 that accumulates during die-cutting. In particular, the air jets are adjustable with respect to position and direction.

FIGS. 23 to 26 illustrate details in the feed area of the stack 8 to be pressed. As a consequence of the inclined arrangement of the die-cutting device 9, said stack rests against the inclined storage plate 75 and supports itself laterally against the main plate 10. A limiting element 88 as well as the slide-in unit 21 are moveably and adjustably mounted relative to the storage plate 75. In this context, the slide-in unit 21 can be driven against a stop 89. Both a central adjustment 90, as well as a dimensional adjustment 91 independent thereof, are provided for the limiting element 88 and the stop 89. The dimensional adjustment is achieved by means of oppositely-threaded screws 93 that are axially fixed in a supporting element 92, which screws accommodate the limiting element 88 and the stop 89, allowing them to be adjusted by means of a knurled knob 94. The central adjustment of the limiting element 88 and the stop 89 are achieved via the supporting element 92, into which a screw 95 connected to an axle extension 96 is threaded, which extension is axially fixed and rotatably-mounted in an extension 97 connected to the plate 75. The screws 93 are likewise connected to an extension 98 that is axially fixed but rotatably-mounted in extension 97.

The toothed belt 27 accommodates the slide-in unit 21 via a pneumatic spring element 99, which can be moved back and forth in the sense of the depicted double arrow. The slid-in position of the slide-in unit 21 is clarified in this figure with solid lines, whereas a partially slid-in position is illustrated by lines in which solid dashes alternate with double points. The slide-in unit 21 contacts the stop 89 in the slid-in position, which in turn limits the slide-in travel of the unit. The pneumatic spring element 99 serves to relieve the drive for the toothed belt 27 when it is driven against the stop 89; or for cases in which the stop 89 moves the slide-in unit 21 counter to the direction of insertion as a result of manual adjustment, particularly manual enlargement of the format via the dimensional adjustment 91.

FIG. 23 illustrates that the punching ram 7 is provided with grooves 100, which extend not only in the plane of the illustration sheet, but also perpendicular thereto and serve to accommodate the guide fingers 22 of the slide-in unit 21, the guide fingers 101 of the limiting element 88, as well as a finger 102 of the hold-down 24, all of which dip into the grooves 100 of the punching ram 7 to a greater or lesser extent, depending upon the dimensional adjustment chosen.

FIG. 24 clarifies that cover plates 103 are connected to the limiting element 88, the stop 89 and the hold-down 24, which plates are oriented in parallel to the plane of the sheets in the stack 8. Corresponding to the stack format as predetermined by means of the limiting element 88, the slide-in unit 21 and the hold-down 24, these plates maintain a punching area that is just slightly larger than the cross-section of the stack 8 as viewed perpendicular to the punch direction.

FIGS. 25 and 26 show that an overhanging arm 104, directed away from the limiting element 88, is connected to the hold-down 24, which arm exhibits a sensor 105 in the area of its free end arranged adjacently to the travel path of the slide-in unit 21, and which senses a separation distance to the surface 20 of the plate 75 corresponding to the variable height adjustment of the hold-down 24. This separation distance is slightly less than the separation distance of the end face 106 of the hold-down finger 102 that faces the surface. This means that if the sensor 105 detects no stack 8 that has been slid in, it is ensured that this stack 8 will not collide with the hold-down finger 102. Should a stack 8 of too large format, or, as illustrated in FIGS. 25 and 26, a tipped Stack (8') be slid in by the slide-in unit 21, despite an adjusted finger 102 and a therefore automatically adjusted sensor 105, the sensor 105 detects this overhanging area of the stack and assumes control of the die-cutting device to the extent that at least the insertion of the stack is interrupted or the machine is completely stopped. In order to prevent the motion of the guide fingers 22 past the sensor 105 from being recognized in the sense of a disturbance, a further sensor 107 is additionally provided, which, upon recognition of an extension 108 of the slide-in unit 21, deactivates the sensor 105, if it has not already been activated. In order to effect the dimensional adjustment, the hold-down finger 102 is adjustable in the sense of the double arrow shown in FIG. 26 by means of a pneumatic adjusting element 109.

What is claimed is:

1. A device for die-cutting a stack of sheet materials, comprising:

a punch platen;

a hollow die-cutter blade;

a frame for receiving and retaining the die-cutter blade, wherein the die-cutter blade is adjustable relative to the frame, and wherein the frame is slideable in a plane parallel to the punch platen and tiltable with respect to the plane, and wherein the frame is adjustable with respect to both orthogonal plane axes;

a receiving apparatus adjustably mounted to the punch platen, wherein the receiving apparatus receives and retains the frame; and a cylinder including a moveable ram for engaging a stack of sheet materials and pressing the sheet materials into the die-cutter blade, wherein an initial position of the punch platen is maintained with respect to the cylinder during operation of the moveable ram.

2. The device of claim 1, wherein the receiving apparatus receives the frame perpendicular to a direction of motion of the ram and the frame is fixable in a position centered with respect to the punch platen.

3. The device of claim 1, wherein the receiving apparatus includes two adjustable parallel gibs which accept the frame.

4. The device of claim 3, wherein the gibs are wedged-shaped and the frame is positioned between the gibs and the punch platen.

5. The device of claim 1, wherein the frame includes a t-slot for receiving a centering bolt that is mounted in the punch platen.

6. The device of claim 3, further including:

a pair of servomotors mounted in the punch platen, wherein the position of the gibs is controlled by the servomotors, and wherein one of the servomotors controls the tilt of a first end of the gibs and the remaining servomotor controls both the tilt and slide of a second end the gibs that is opposite the first end of the gibs.

7. The device of claim 6, wherein the direction of adjustment for the servomotors is essentially perpendicular to the direction of adjustment for the centering bolt.

8. The device of claim 3, further including:

a clamping element mounted in one of the gibs, wherein the clamping element presses the frame against the other gib when the frame is in a desired position thereby fixing the relationship of the receiving apparatus and the frame.

9. The device of claim 3, wherein the adjustment of the gibs is facilitated with electric motors.

10. The device of claim 8, wherein the clamping element is a pneumatic cylinder that engages the centering bolt to retain the frame and the receiving apparatus in the fixed relationship.

11. The device of claim 1, further including:

an adjusting element mounted in the frame for facilitating alignment of a knife edge portion of the die-cutter blade with respect to the frame.

12. The device of claim 11, wherein the adjusting element is an adjusting ruler.

13. The device of claim 1, wherein the frame further includes:

a frame portion;

a primary clamping beam which is slideable with respect to the frame portion and fixable to parallel lateral legs of the frame portion, wherein the die cutter blade is retained between one of a pair of short legs of the frame portion and the primary clamping beam; and a secondary clamping beam which is slideable with respect to the frame portion and fixable to the parallel lateral legs of the frame portion, wherein the secondary clamping beam is parallel to the primary clamping beam and includes clamping agents that are adjustable to apply a force against the primary clamping beam.

14. The device of claim 1, wherein the frame further includes:

a frame portion; and at least one clamping beam which is adjustable with respect to the frame portion and fixable to parallel lateral legs of the frame portion, wherein the die-cutter blade is retained between one of a pair of parallel short legs of the frame portion and the primary clamping beam, and wherein each end of the clamping beam and the frame portion associated with the pair of parallel short legs are in contact with the punch platen.

* * * * *

UNITED STATES PATENT AND TRADEMARK OFFICE

CERTIFICATE OF CORRECTION

PATENT NO. : 6,959,634 B2
DATED : November 1, 2005
INVENTOR(S) : Helmut Gross et al.

It is certified that error appears in the above-identified patent and that said Letters Patent is hereby corrected as shown below:

Title page,
Item [57], ABSTRACT,
Line 13, after "platen 12," insert -- and --.

Column 7,
Line 16, "conneci" should be -- connect --.
Line 66, "Blade" should be -- blade --.

Column 8,
Line 2, "Frame" should be -- frame --.

Column 9,
Lines 56, 57, 59 and 60, "cross-section" should be -- cross section --.

Column 11,
Lines 31 and 32, "cross-section" should be -- cross section --.

Column 12,
Line 31, after "end" insert -- of --.

Signed and Sealed this

Fourth Day of April, 2006

JON W. DUDAS
*Director of the United States Patent and Trademark Office*